United States Patent [19]

Adams et al.

[11] 4,112,726

[45] Sep. 12, 1978

[54] METHOD AND APPARATUS FOR FORMING A ROW OF SPRING COILS FROM A CONTINUOUS LENGTH OF WIRE

[75] Inventors: Elvin E. Adams; Tom J. Wells, both of Carthage, Mo.; Horst F. Wentzek, Kenosha, Wis.; Henry Zapletal, Carthage, Mo.; Marty J. Zugel, Cleveland, Ohio

[73] Assignee: Leggett & Platt, Incorporated, Carthage, Mo.

[21] Appl. No.: 832,399

[22] Filed: Sep. 12, 1977

[51] Int. Cl.[2] ..... B21F 27/16

[52] U.S. Cl. ..... 72/137; 140/3 CA

[58] Field of Search ..... 140/1, 3 R, 3 CA, 102, 140/105, 103; 72/137, 138

[56] References Cited

U.S. PATENT DOCUMENTS

| | | | |
|---|---|---|---|
| 3,188,845 | 6/1965 | Gerstorfer | 72/138 |
| 3,472,290 | 10/1969 | Sykes et al. | 140/3 CA |
| 3,476,156 | 11/1969 | Simons | 140/3 CA |

*Primary Examiner*—Lowell A. Larson

*Attorney, Agent, or Firm*—Wood, Herron & Evans

[57] ABSTRACT

A single continuous length of spring wire is formed into a continuous length spiral or helix which is subsequently folded into a wave configuration for establishing in row form, a plurality of individual spring coils disposed generally parallel one to another. Each coil in the row is connected at its opposite ends to adjacent coils by head or connector end sections. The head or connector end sections are then formed, preferably into a planar Z-shaped configuration such that the formed connector sections at the same ends of the coils are disposed in a common plane normal to the axes of the coils which they interconnect. During forming of the end sections or heads of the coils, each connector section is deformed from a looped three-dimensional attitude into the planar Z-shaped attitude by interengagement with novel forming pins and forming dies.

49 Claims, 30 Drawing Figures

FRONT
REAR

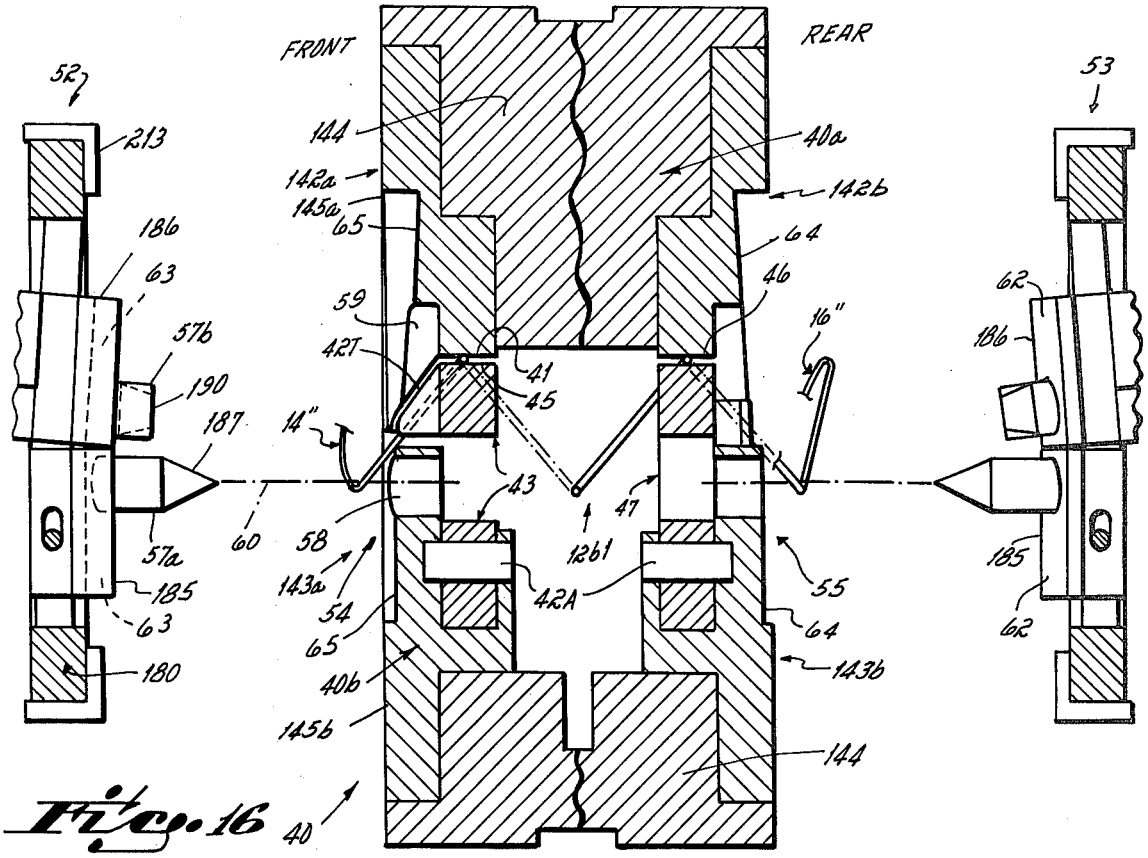
Fig. 16
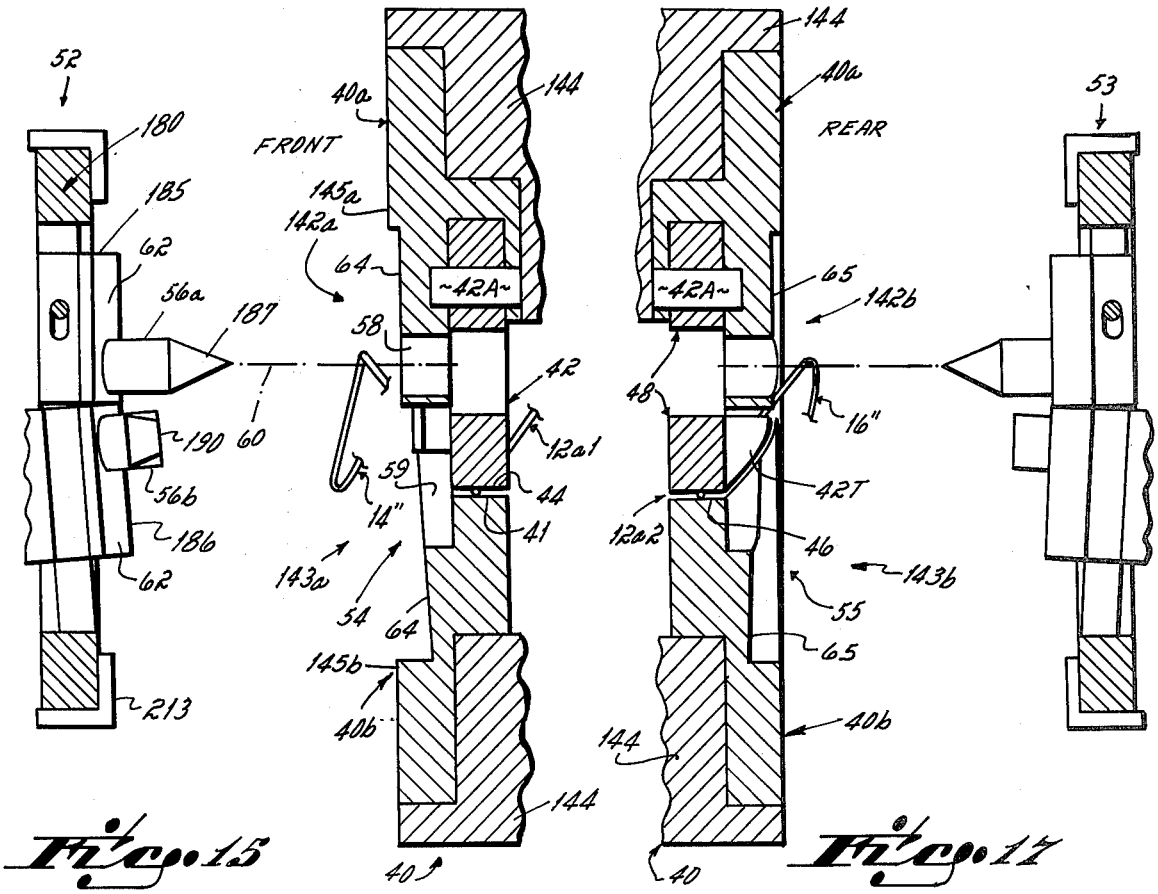
Fig. 15
Fig. 17

METHOD AND APPARATUS FOR FORMING A ROW OF SPRING COILS FROM A CONTINUOUS LENGTH OF WIRE

This invention relates to coil springs. More particularly this invention relates to method and apparatus for forming a row of spring coils from a continuous length of wire.

There are many different spring assemblies known to the prior art. One basic use of spring assemblies is in the bedding industry where those spring assemblies find use as mattresses and box springs. While spring assemblies known to the prior art are of various configurations, most such assemblies employ a plurality of rows of spring coils interconnected in the top and bottom planes of an assembly defined by those coils. The interconnection may be by spiral wire lacings, by a welded wire grid, by individual hog rings or the like. And in such assemblies, it is most often the case that the spring coils within each coil row are initially separate one from the other. Thus, the separate spring coils within each row must be interconnected, as well as adjacent rows must be interconnected, to fabricate the final spring assembly.

Such prior art spring assemblies, varied though they are in final configuration and structure, all are subject to one short-coming or another. One problem associated with such multiple individual spring prior art assemblies is the quantity of wire employed to make up each individual spring coil. Another problem is that of interconnecting the individual spring coils into rows of coils, and those rows into a plurality of interconnected coil rows. Some prior art coil row configurations, of individual spring coils, and some of the prior art spring assemblies, are even subject to hand assembly. Both of these problems result in increased manufacturing cost to the spring assembly fabricator.

One approach to the problems associated with prior art spring assemblies, as discussed above, is to provide a plurality of rows of spring coils in which each coil row is formed from a single continuous length of spring wire. In other words, and although multiple coil rows are required to make up the spring assembly's coil spring matrix, each row of coils is fabricated from a single continuous length of wire. In this coil row structure, adjacent coils are connected by a connector section disposed in either the top plane or the bottom plane, but not both the top and bottom planes, of the coil row. This type of coil row structure, i.e. the type where each row of coils is formed from a single continuous length of spring wire, is known to the prior art as previously mentioned. Typical of such coil row structures are those illustrated in Higgins et al. U.S. Pat. No. 3,911,511, Norman U.S. Pat. No. 3,657,749 and Norman U.S. Pat. No. 3,355,747.

One of the primary advantages of a coil row structure in which the row of coils is formed from a single continuous length of spring wire is that, at least theoretically, the coil row structure should be capable of being formed by machine without manual assistance. However, until the discovery of the invention of this application, all prior attempts of which we are aware, to machine form a continuous coil spring proved to be impractical. In general those prior attempts all involved a continuous motion machine which simultaneously folded and formed the end coils of a continuous strand of helically wound wire. That continuous motion machine though was so complex and so subject to misalignment and ultimately to breakage that it was impractical to operate for a sufficiently long time to manufacture a sufficient number of products to justify commercializing the product. Consequently, that continuous motion machine was abandoned.

Thus, it has been a primary objective of this invention to provide a novel and practical method and apparatus for forming a row of spring coils from a continuous length of wire. In accord with this objective, the novel method and apparatus of this invention involves forming a single continuous length of spring wire into a continuous length spiral or helix. Subsequently, the continuous length helix is folded into a generally wave configuration for establishing in row form, a plurality of individual spring coils disposed generally parallel one to another. After the continuous length helix has been folded into multiple parallel coils, the head or end connector sections are formed, preferably into a planar Z-shaped configuration, the formed connector sections at the same ends of the coils being disposed in a common plane normal to the axes of the coils which they interconnect. During forming of the end sections, each connector is deformed by interengagement with forming pins and forming die faces that transform the connector or end sections from a looped three-dimensional attitude into the planar Z-shaped attitude.

In general, the invention of this application is predicated upon the concept of first folding the helically wound wire into sinusoidal wave form and then subsequently forming the head or end connector sections of the coils into planar end configuration. By sequencing the folding and forming operations, rather than effecting them simultaneously, the machinery for practicing the process and for carrying out the manufacture is now practical from both a cost and maintenance standpoint.

Other objectives and advantages of this invention will be more apparent from the following detailed description taken in conjunction with the drawings in which:

FIG. 13 is a perspective view of the hold-down die, in the open position, without coils in operational relation therewith;

FIG. 16 is an end cross-sectional view taken along line 16—16 of FIG. 12 showing the front and rear forming dies in the retracted position relative to the closed hold-down die;

FIG. 17 is an end cross-sectional view taken along line 17—17 of FIG. 12 showing the rear forming die in the retracted position relative to the closed hold-down die;

COIL ROW FORMING METHOD

Figures 1, 2A, 2B:
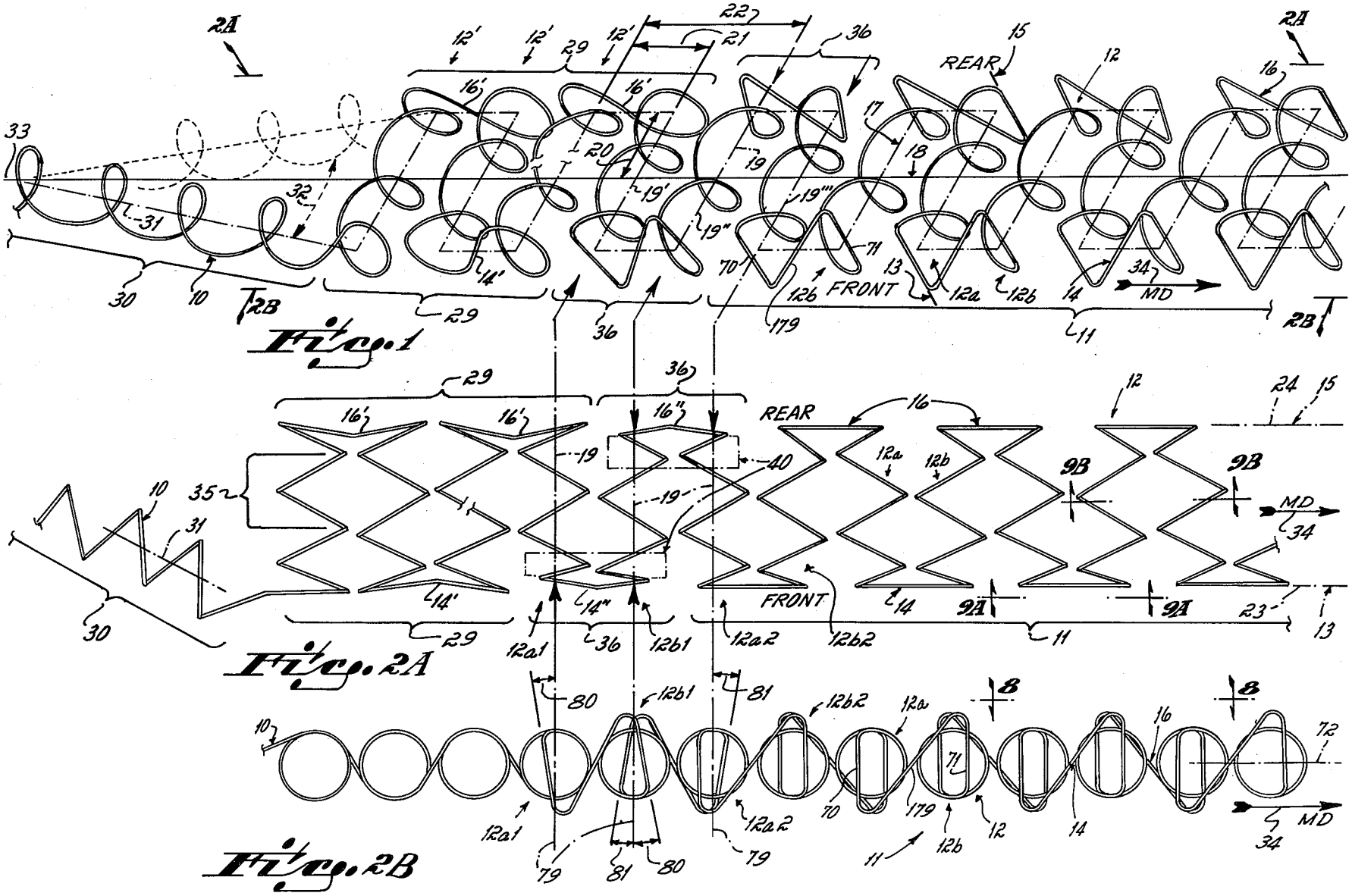
FIG. 1 is a perspective view illustrating the method of this invention in which a continuous length wire is transformed therefrom into a row of spring coils.
FIG. 2A is a top view of the row of coils illustrated in FIG. 1, and is taken along line 2A—2A of FIG. 1.
FIG. 2B is a front view of the row of coils illustrated in FIG. 1, and is taken along line 2B—2B of FIG. 1.

The coil row forming method of this invention is particularly illustrated in FIGS. 1-9. The coil row forming method is particularly adapted to transform a continuous length of spring wire 10 into a row 11 of spring coils 12, see FIGS. 1, 2A and 2B. The coils 12 within that row 11 are connected at the front or top end 13 thereof by Z-shaped connector sections 14 and at the rear or bottom end 15 thereof by Z-shaped connector sections 16. Successive coils 12 are alternately connected at the front end 13 by a front connector section 14, and then at the rear end 15 by a rear connector section 16. This structure establishes a generally square wave configuration (note square wave phantom line 17) for the coil row 11 in which the coils 12 constitute the perpendicular legs (relative to the center line 18 of the wave form) and the connector sections 14, 16 constitute the parallel leg (relative to the center line 18 of the wave form) of the square wave configuration 17. Further in this regard, the row 11 of coils 12 so formed may be described as comprised of a plurality of pairs **12*a*, 12*b* of coils, each coil pair 12*a*, 12*b* being connected at one end 13 by a Z-shaped connector section 14, and adjacent pairs 12*a*, 12*b* of coils having the adjacent coils 12*b*, 12*a* of those adjacent pairs connected at the other end 15 by another Z-shaped connector section 16. More particularly, note that the coils 12 in coil row 11 are disposed parallel one to the other as illustrated by the coil center lines 19, and the coils are of the same length relative one to another as illustrated by the standardized amplitude 20 of the square wave form 17. Further, note that the center line distance 21 between adjacent coils 12 is equal throughout the coil row 11 length as illustrated by the standardized wave length 22 of the square wave form 17. This results in the planar connector sections 14 and 16 at the same ends 13 and 15, respectively, of the coils 12 being disposed in a common plane 23, 24, respectively, normal to the axis 19 of the coils which they interconnect. In other words, connector sections 14 at end 13 of the coils 12 are disposed in a common plane 23, and connector sections 16 at end 15 of the coils are disposed in a common plane 24, both those planes 23, 24 being disposed normal to the coils' axes 19. Only a portion of a complete coil row is illustrated by coil row section 11 shown in FIGS. 1, 2A and 2B, it being understood that the completed coil row may be as long as desired, i.e., fabricated from as many coils 12 connected by connector sections 14, 16** as desired.

The first step in forming the coil row is shaping a single continuous length spring wire into a continuous length helical configuration from, e.g., a linear configuration. Preferably the helix is circular, and has the same dimensional characteristics throughout its length. The continuous length circular helix (a section 30 of which is illustrated in FIGS. 1 and 2A) then functions as the spring wire input or infeed to the subsequent shaping steps. While linear continuous length spring wire may be formed into the continuous length circular helix 30 by any known method desired, it is preferred that the continuous length helix be fabricated using the mechanical forming methods and equipment illustrated in either Norman U.S. Pat. No. 3,541,828 or Huhnen U.S. Pat. No. 3,802,241. A continuous length helix 30 formed in accord with the method and equipment disclosed in either of those patents, and having center line 31, is acceptable as the continuous length helix infeed from which is fabricated a coil row 11 in accord with the principles of this invention.

After the continuous length helix 30 has been formed, it is then folded into the generally square wave 17 configuration as illustrated in FIGS. 1 and 2A. The folding step, therefore, establishes the continuous length helix section 30 into a plurality of parallel coils 12 with connector sections 14', 16' therebetween. In other words, and by being transposed from the linear helix as illustrated by section 30 into the folded helix as illustrated by section 29, connector sections 14', 16' are provided between spaced parallel coils 12 of equal length, but the connector sections are in a three-dimensional looped attitude at this stage as shown by that section 29. The square wave 17 configuration is attained by oscillating the continuous length helix 30 infeed, through oscillation path 32 from a generally common center point 33 located on the centerline 18 of the square wave form while moving the square wave form in a machine direction 34. This oscillation 32 is of an amplitude 20 equal to the amplitude of the square wave configuration 17 for the continuous length coil row 11 finally formed. In this connection, compare the solid line position of the continuous length helix infeed section 30 to the phantom line position as shown in FIG. 1, it being apparent therefrom that the amplitude 20 of the square wave 17 configuration for the continuous coil row section 11 is defined by the distance between center line 31 positions of the helix infeed section 30 as defined by extremes of the swing of that section 30. Thus, the continuous length helix infeed section 30 is taken from its linear center line 31 attitude, and transformed into a square wave form 17, by folding the continuous length helix 30 back upon itself in accordian-like fashion at spaced intervals so as to define the final continuous coil row 11 configuration desired.

The folding step in forming the final continuous coil row 11 determines the number of helical loops 35 within each coil 12 of the finished coil row section 11. As illustrated herein, each spring coil 12 within the coil row section 11 is provided with three and one-half helical loops 35. However, two and one-half helical loops or four and one-half helical loops or more, or less, may be provided as desired by the fabricator in light of the end use of the final continuous coil row 11. In this regard, note particularly that the number of helical loops 35 within each spring coil 12 is equal to a unit number plus one-half. The reason for this is to maintain parallelism between successive coils 12' in the folded coil row section 29 while providing connector sections 14', 16' of a single loop 35 in length and of a three-dimensional looped configuration which permits subsequent forming into the planar Z-shaped configuration. Thus, and as just mentioned, each folded but not formed connector section 14', 16' is in fact comprised of a single helical loop 35 that connects adjacent coils 12'. The general configuration of each single loop connector section 14' and 16' takes a three-dimensional looped attitude as illustrated in the folded, but unformed, connector sections 14' and 16' of the folded coil row section 29 illustrated in FIGS. 1 and 2A.

After the continuous length helix 30 has been folded from the linear input attitude (coil section 30) into the folded attitude (coil section 29), the connector sections 14' and 16' between adjacent coils 12' of the coil row folded section 29 are then formed into a planar Z-shaped attitude from the three-dimensional looped attitude generated in the folding step. The forming step includes two separate sub-steps as the looped connector sections 14', 16' between adjacent coils 12' must be transformed from the three-dimensional looped attitude illustrated in FIGS. 1, 2A and 2B into a planar or two-dimensional Z-shaped configuration illustrated in those same figures. In other words, the connector sections 14' and 16' formed between adjacent coils 12' upon folding of the continuous length helix input section 30 must be flattened from a spiral-like attitude into a planar attitude, and must be transformed from a curved attitude into a Z-shaped attitude. The forming of the connector sections 14', 16' in such a manner is particularly illustrated in FIGS. 1–9. In this forming step, the end connector section 14'' of a pair **12*a*1, 12*b*1 of coils is so formed, and the end connector section 16'' that connects adjacent coils 12*b*1, 12*a*2 in adjacent coil pairs is likewise so formed, both being formed simultaneously. In this regard, and in the forming step, the connector section 14'' that connects the coils 12*a*1, 12*b*1 within a single pair (i.e., the trailing coil 12*a*1 and the center coil 12*b*1 relative to the machine direction 34) is hereafter referred to as the front connector section, and the connector section 16'' that connects adjacent coils 12*b*1, 12*a*2 of adjacent coil pairs (i.e., the center coil 12*b*1 and the leading coil 12*a*2 relative to the machine direction 34) is hereafter referred to as the rear connector section, for those coils 12*a*1, 12*b*1, 12*a*2 within forming section 36** of the continuous coil row being formed as viewed from left to right in the figures.

Before either of the two sub-forming steps can be carried out, one pair of coils **12*a*1, 12*b*1, and an adjacent coil 12*a*2 to that pair, must be held in fixed relation, i.e., hold-down relation, one with another. In this hold-down relation, the coils 12*a*1, 12*b*1, 12*a*2 are maintained in parallelism, note the parallelism of center lines 19 shown in FIG. 2A. Of the three coils so held down, the center coil 12*b*1 is held at both the front and rear thereof as shown in FIGS. 2A and 3–5. The trailing coil 12*a*1, i.e., the other coil of the coil pair 12*a*1, 12*b*1, is held down at the front thereof only, and the leading coil 12*a*2, i.e., the adjacent coil of the adjacent coil pair 12*a*2, 12*b*2, is held down at the rear thereof only, also as shown in FIGS. 2A and 3–5. Thus, both coils 12*a*1, 12*b*1 of one coil pair are held down at the front 13 thereof, but only the coil 12*b*1 of that coil pair is held down at the rear 15 thereof, and the adjacent coil 12*a*2 of the adjacent coil pair 12*a*2, 12*b*2 also is held down at the rear thereof. As shown diagrammatically in FIGS. 3–9, the spring coils 12*a*1, 12*b*1, 12*a*2, are held down by a hold-down die 40 that includes front hold-down seats 41 cooperable with front hold-down arms 42, 43 that holds down the front 13 portions of the spring coils 12*a*1, 12*b*1 in fixed relation as at 44, 45, respectively. Further, the hold-down die 40 includes rear hold-down seats 46 cooperable with rear hold-down arms 47, 48 that hold the rear 15 portions of the spring coils 12*b*1, 12*a*2 in fixed relation as at 49, 50**, respectively.

After immobilizing adjacent spring coils **12*a*1, 12*b*1, 12*a*2 interiorly of or between the front end 14''** and rear end 16" connector sections that connect those spring coils together, those connector sections are transformed from the three-dimensional looped attitude into the planar or two-dimensional Z-shaped attitude. In other words, the connector section 14" that connects the two coils 12a1, 12b1 of a coil spring pair, and the connector section 16" that connects one coil 12b1 of that pair with an adjacent coil 12a2 of an adjacent coil pair, are transformed from the three-dimensional looped attitude 14', 16' caused upon folding of the continuous length helix 30 into the square wave configuration 17 into the planar Z-shaped attitude 14, 16. In the planar Z-shaped attitude, the connector sections 14, 16 are in common planes 23, 24, respectively, normal to the axes 19 of the spring coils 12 in the coil spring row 11, and parallel to the center line 18 of the coil spring row. This transformation of the looped attitude connector sections 14', 16' into Z-shaped attitude sections 14, 16 is apparent from a review of FIGS. 1, 2A and 2B.

Figures 3, 4, 5, 6A, 6B, 7A, 7B, 8, 9A, 9B:
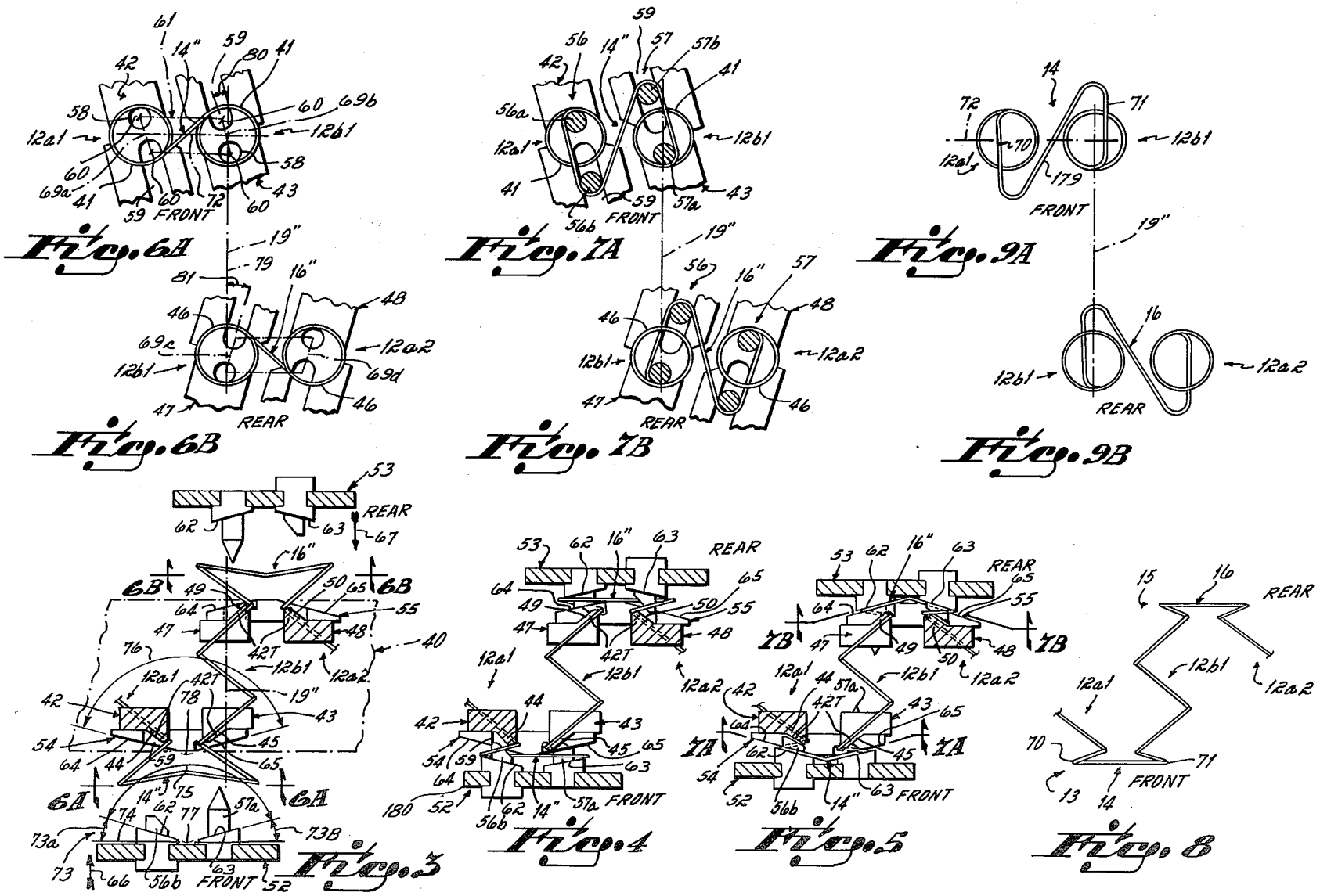
FIG. 3 is a top diagrammatic view of leading, middle and trailing spring coils in operational relation with a hold-down die, and with front and rear forming dies, prior to forming front end spring wire connector sections, and prior to forming a rear end spring wire connector section, from a three-dimensional looped attitude to a planar Z-shaped attitude.
FIG. 4 is a top diagrammatic view similar to FIG. 3 but illustrating an intermediate position of the hold-down die and the forming dies as the front end and rear end connector sections are transformed from the three-dimensional looped attitude into the planar Z-shaped attitude.
FIG. 5 is a view similar to FIG. 4, but illustrating the final position of the hold-down die and the forming dies as the front end and rear end connector sections are transformed from the three-dimensional looped attitude into the planar Z-shaped attitude.
FIG. 6A is a cross-sectional view taken along line 6A—6A of FIG. 3.
FIG. 6B is a cross-sectional view taken along line 6B—6B of FIG. 3.
FIG. 7A is a cross-sectional view taken along line 7A—7A of FIG. 5.
FIG. 7B is a cross-sectional view taken along line 7B—7B of FIG. 5.
FIG. 8 is a partially broken away top view of the front end and rear end connector sections between leading, middle and trailing coils after release of those coils from the hold-down die and the forming dies, and is taken along line 8—8 of FIG. 2B.
FIG. 9A is a front view of the front end connector section between the middle and trailing coils after release of those coils from the hold-down die and the forming dies, and taken along line 9A—9A of FIG. 2A.
FIG. 9B is a front view of the rear end connector section between the middle and leading coils after release of those coils from the hold-down die and the forming dies, and taken along line 9B—9B of FIG. 2A.

The forming of the spring coils' connection sections 14", 16" from the three-dimensional looped attitude into the two-dimensional Z-shaped attitude is accomplished by cooperation of front 52 and rear 53 forming heads that cooperate with front 54 and rear 55 forming plates of the hold-down die 40, see FIGS. 3–5. Each of the front 52 and rear 53 forming heads includes two pairs 56, 57 of forming pins, one pin 56a and 57a of each pair being stationary and receivable in bore 58 in the hold-down die's forming plate 54 or 55, and the other pin 56b and 57b of each pair being movable and being receivable in slot 59 defined in that plate 54 or 55, compare FIGS. 3 and 5 with FIGS. 6A–7B. In this regard, note the pin 56, 57 geometry defined by the pin axes 60 for each of the front and rear set of forming pin pairs 56, 57 is a parallelogram 61 when viewed from the front and rear as shown in FIGS. 6A–7B. In this parallelogram 61 geometry, the movable pins 56b and 57b are located at opposite corners of the parallelogram. In use, forming faces 62, 63 on the front 52 and rear 53 forming heads are brought into forming proximity with forming faces 64, 65 on the front 54 and rear 55 forming plates fixed to the hold-down die 40 by moving the front 52 and rear 53 forming heads toward the stationary and closed hold-down die 40 as shown by directional arrows 66, 67, respectively, see the forming head 52, 53 sequence illustrated in FIG. 3 to FIG. 5. This transposes the three-dimensional looped attitude of connector sections 14", 16" into an inwardly directed V-shaped attitude as shown in FIG. 5, which V-shaped attitude results in a planar configuration for connector sections 14, 16 in the coil row 11 after removal of coils 12a1, 12b1, 12a2 from the forming steps as explained in greater detail below.

As the front 52 and rear 53 forming heads approach the stationary hold-down die 40, each pair 56, 57 of pins is disposed within one-half the loop of a three-dimensional loop connector section 14", 16" with the pins being in a retracted attitude, see FIGS. 4, 6A and 6B. In this intermediate forming position, the front forming head's pair 56 is operatively associated with the trailing coil 12a1, and the front forming head's pin pair is operatively associated with the center coil 12b1, through interengagement of each pin pair 56 and 57 with a half-loop of front end connector section 14". The rear forming head's pin pair 56, 57 are similarly associated with center coil 12b1 and leading coil 12a2, and with rear end connector section 16". In this regard, note each pair of pins 56 and 57 is disposed on a diameter line 69 (which is one side of parallelogram 61) of the coil 12a1, or 12b1 or 12a2 it serves. In use, and after the front 52 and rear 53 forming heads have moved inwardly against front and rear forming faces 64, 65 defined on the hold-down die's front 54 and rear 55 forming plates, i.e., have moved into the FIG. 5 position, one 56b and 57b of each pair 56, 57 of pins on each forming head 52, 53 is moved radially outward relative to the center line 19 of the coil 12a1 or 12b1 or 12a2 with which it is disposed. As pins 56b, 57b of each front 52 and rear 53 forming head extend away from their associated pins 56a, 57a (which associated pins 56a, 57a of each pair remain stationary or fixed), connector section 14", 16" is transformed into a Z-shaped attitude, compare pin pair 56, 57 parallelogram 61 positions in FIGS. 6A and 6B (the pins being retracted) with those positions shown in FIGS. 7A and 7B (the pins being inserted and spread).

In forming the connector sections 14, 16 from the three-dimensional looped attitude into the planar Z-shaped attitude, compensation is provided in the forming step to accommodate for the spring or modulus of elasticity characteristics of the spring wire itself. With regard to the desired planarity of the end connector sections 14, 16 and as illustrated in FIGS. 3–5, the front 52 and rear 53 forming heads' forming faces 62, 63 are each disposed at an angle 73 of 15° relative to a phantom plane 74 normal to plane 72 (plane 72 includes the coils' axes 19). This defines an included V-shaped or obtuse angle 75 of 150° that opens inwardly toward the coil row's axis 18. The front 54 and rear 55 forming plates' forming faces 64, 65 on the hold-down die 40 are similarly angled relative to phantom plane 74 so as to define an included obtuse angle 76 equivalent to the associated forming head's angle 75. Note that the phantom corners 77, 78 of angles 75, 76, respectively, are located midway between the center axis 19 of that coil 12a1 or 12b1 or 12a2 associated with the forming faces 62, 63, 64, 65 being viewed. The forming face position angles 73 of 15° is preferred for use with that type spring wire commonly used in a box spring structure for bedding purposes, the angles 73, 75, 76 being varied depending on the characteristics of the spring wire 10 being formed. The initial position of the front 52 and rear 53 forming heads relative to the front 54 and rear 55 forming plates is illustrated in FIG. 3. An intermediate position in which the front end 14" and rear end 16" connector sections have been translated from the three-dimensional loop attitude into a generally planar attitude is illustrated in FIG. 4, same occurring by virtue of the front 52 and rear 53 forming heads approaching the stationary front 54 and rear 55 forming plates, respectively, in the motion direction illustrated by phantom arrows 66, 67, respectively. Release of the connector sections 14", 16" from the FIG. 4 attitude would result in those connector sections springing back to some extent toward their initial three-dimensional attitude. Hence, the front 52 and rear 53 forming heads continue to move inwardly relative to the center line 18 of the coil row 11 until the front 14" and rear 16" connector sections are bent into an inwardly directed (relative to the coil row's axis 18) obtuse angle 75 as illustrated in FIG. 5, and as defined by cooperative relation of the forming faces 62, 63 on the front 52 and rear 53 forming heads with the forming faces 64, 65 on the front 54 and rear 55 forming plates, respectively. This over-bending of the connector sections 14", 16" into an obtuse angle 75 results, when the coils 12a1, 12b1, 12a2 are released from the hold-down die 50 and forming heads 52, 53, in substantially planar connector sections 14, 16 disposed in common planes 13, 15, respectively, see FIG. 8.

Also, it is desirable that the spaced parallel legs 70, 71 of the Z-shaped connector sections 14, 16 be all disposed parallel one to another from one end of the coil row 11 to the other, and that those legs 70, 71 be disposed normal relative to the row center plane 72 that includes the coils' centerlines 19, see FIGS. 2B, 9A, and 9B. In the case of spring wire of the type normally to be used in box springs, the front end Z-shaped connector 14'' is preferably formed with its legs 70, 71 disposed at a 15° angle 80 to one side of a phantom plane 79 disposed normal to the center plane 72 of the completed coil row 11, and the rear end Z-shaped connector 16'' is preferably formed with its legs located at a 15° angle 81 to the other side of the phantom plane 79, thereby defining an included angle 80, 81 of 30°, see FIGS. 2B, 7A and 7B. This relationship is established by locating the front forming heads' pin pairs 56, 57 on spaced parallel lines **69*a*, 69*b* angled at 15° to one side of phantom plane 79, and the rear forming heads' pin pairs 56, 57 on spaced parallel lines 69*c*, 69*d* angled at 15° to the other side of phantom plane 79, see FIG. 6A (when retracted) and 7B (when extended). In this regard, therefore, the Z-shaping sub-step induces a left hand twist to the front sections of the trailing 12*a*1 and middle 12*b*1 coils, and a right hand twist to the rear sections of the leading 12*a*2 and middle 12*b*2 coils, as viewed in FIG. 2B, those opposite direction twists permitting those Z-shaped connector sections 14'', 16'' to spring back into the desired completed coil row 11 attitude illustrated in FIGS. 9A and 9B after the coils 12*a*1, 12*b*1, 12*a*2 have been released from the front 52 and rear 53 forming heads and the hold down die 40**.

As a final step in the fabrication of a coil row 11, the continuous length wire 10 is simply cut to provide a coil row of the desired length. Thus is formed a coil row 11 in which a plurality of multi-loop spring coils 12 are disposed parallel one to the other, coil pairs **12*a*, 12*b* being connected by a Z-shaped connector 14 of planar configuration at one end thereof, and adjacent coil pairs 12*b*, 12*a* being connected one with another by Z-shaped planar connectors 16 at the other end thereof, that coil row being fabricated from an initially straight continuous length spring wire 10** filament.

Coil Row Forming Apparatus

The apparatus of this invention preliminarily includes folding station apparatus and forming station apparatus for transforming a continuous length spring wire helix into a row of parallel spring coils. The folding station structure is particularly illustrated in FIG. 10, and the forming station structure is particularly illustrated in FIGS. 11-21B.

Folding Station Apparatus

The initial step in the method of this invention is transforming a continuous length linear spring wire into a continuous length circular helix. Preferred apparatus for so shaping the linear continuous length wire is disclosed in Norman U.S. Pat. No. 3,542,828 and Huhen U.S. Pat. No. 3,802,241 as previously described above. Once the continuous length helix has been formed, the linear helix feed section 30 is folded into a square wave 17 configuration as discussed above. The apparatus illustrated in FIG. 10 constitutes folding station apparatus at which the continuous length helix is folded into the square wave configuration.

Figure 10:
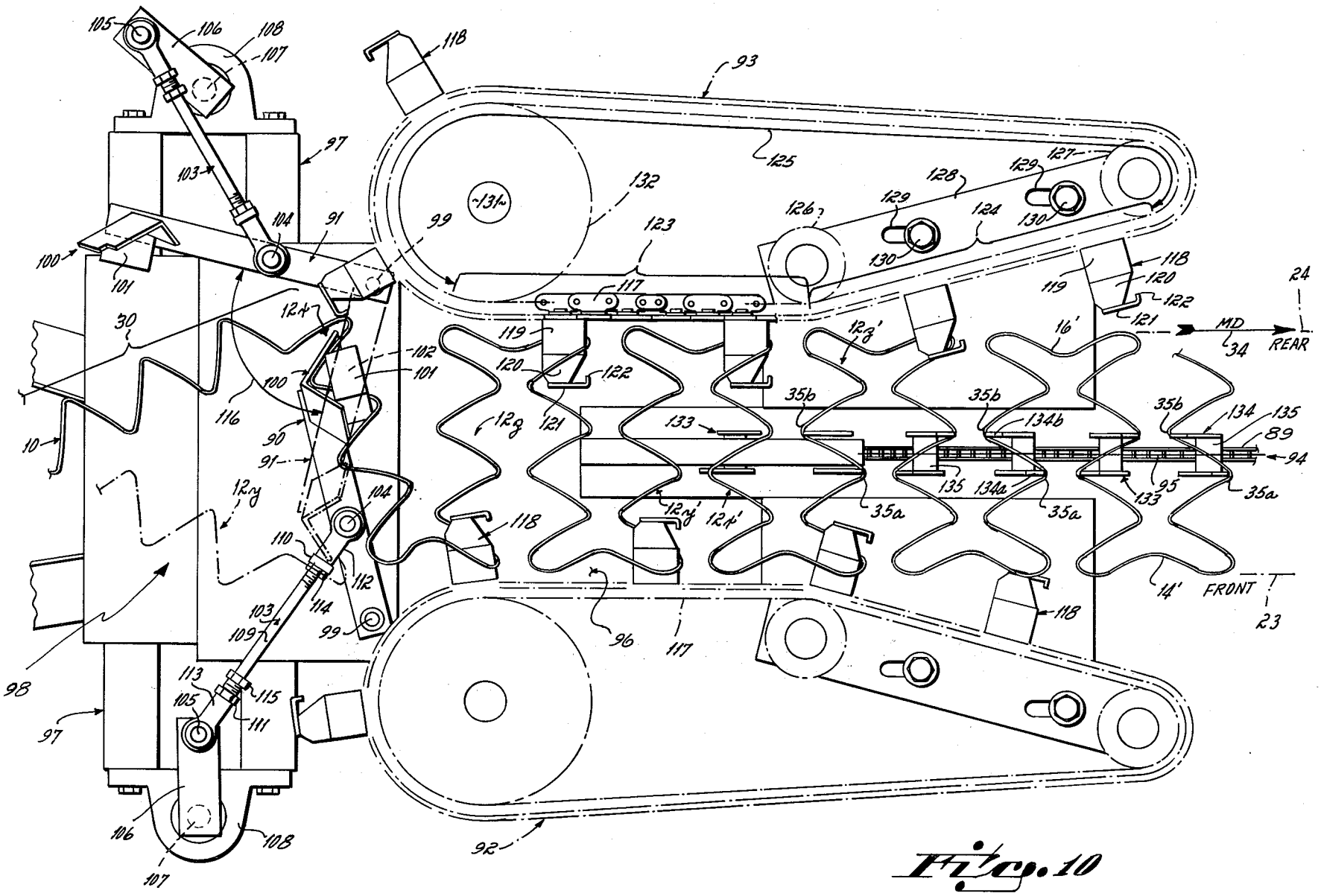
FIG. 10 is a top view of folding station structure in which a continuous length helix is folded from its single axis configuration into a coil row configuration.

The folding station apparatus, as illustrated in top view in FIG. 10, includes front 90 and rear 91 folding arms operable in timed sequence one with another, the folding arms functioning to oscillate the continuous length helix 30 in a horizontal plane from one side of the apparatus to the other so as to preliminarily fold that helix toward the square wave 17 configuration. Front 92 and rear 93 folding conveyors are positioned downstream (relative to machine direction 34) from the folding arms 90, 91, the folding conveyors taking the preliminarily folded coils 12 from the folding arms and positively orienting same in the folded attitude with coil axes 19 being disposed parallel one to the other. In this folded attitude, front end 14' and rear end 16' connector sections are in a three-dimensional, looped attitude. The folding conveyors 92, 93 (which operate in a horizontal plane) also function to convey the square wave folded helix from the folding arms 90, 91 into operational relation with transfer conveyor 94 (which operates in a vertical plane 95). After the folded helix section 29 is interengaged with the transfer conveyor 94, the transfer conveyor conveys it away from the folding station apparatus, and then into and through the forming station apparatus, as described in detail below. The conveyor speeds of folding conveyors 92, 93 and transfer conveyor 94 are in time relation one with the other.

More particularly, the folding station apparatus includes a horizontal bed 96 supported by framework 97, the bed including an infeed section 98 onto which the continuous circular helix 30 is initially directed, and then oscillated by the folding arms 90, 91. The folding arms 90, 91 are located on opposite sides of the support bed's infeed section 98, and each folding arm is mounted to the bed plate 96 by pin 99 at a downstream end thereof relative to the machine direction 34 of the folding station apparatus. Each folding arm 90, 91 includes shaped fingers 100, 101 disposed at the outer end thereof, one angled finger 100 being generally vertically disposed, and the other angled finger 101 being generally horizontally disposed, so as to provide an entrapment cavity 102 in which a loop 35 of the continuous length helix 30 may be entrapped for gripping of the helix during folding thereof.

Each folding arm 90, 91 is pivoted or oscillated by a drive mechanism that includes primary drive arm 103 pivotally connected at one end 104 intermediate the ends of the folding arm, and pinned at the other end 105 to secondary drive arm 106 fixed to rotating drive shaft 107. The rotating drive shaft 107 is carried in a suitable pillow block 108 bolted to the framework 97 of the folding station apparatus. Note particularly each primary drive arm 103 incorporates a center rod 109 threadedly received at opposite ends in collars 110, 111 carried by mounting brackets 112, 113, respectively, nuts 114, 115 being provided to tighten the center rod 109 in fixed relation relative to those end brackets 112, 113. This center rod 109 structure provides an adjustable primary drive arm 103 that can be adjusted in length relative to the folding arm 90 and the secondary drive arm 106 for adjusting the oscillation path 116 length of the folding arm 90 or 91 to accommodate continuous length circular helixes 30 of different dimension characteristics if desired or necessary. The front end rear drive shafts 107 are rotated in timed relation relative to the conveyor speed of the folding conveyors 92, 93, and are controlled by control mechanism not shown. Thus, the folding arms 90, 91 oscillate back and forth in timed sequence relative one to another in a horizontal plane.

Each folding conveyor 92, 93 is in the nature of an endless conveyor having an endless conveyor path. Each front 92 and rear 93 conveyor is fabricated of the usual chain 117 link with particularly novel pick-up feet 118 connected in outwardly extending spaced relation thereon. Each foot 118 includes a cylindrical leg portion 119 fixed to the conveyor chain that terminates at its outer end with a generally frustoconical shaped angle portion 120. A forwardly directed toe 121 (relative to the machine direction 34 of the folding station apparatus) is fixed on the end of that ankle section 120, the toe including an inwardly turned (relative to the conveyor 92 or 93 to which it is attached) nail portion 122 at the leading edge thereof. Each conveyor defines a capture path section 123 disposed parallel to the machine direction 34 of the folded coil row section 29, and a release path section 124 which angles away from the machine direction of the folded coil row, as well as a return path section 125. The release path section 124 is defined by idler sprockets 126, 127 rotationally mounted to support plate 128, the plate 128 being adjustable through use of slots 129 and bolts 130 so as to maintain the conveyor chain 117 in taut relationship. Each conveyor 92, 93 is driven through drive shaft 131 and sprocket 132 by motor and control means, not shown. The conveyor speed of the folding conveyors 92, 93 is equal one to the other, and is set in timed relation to the oscillation speed of the folding arms 90, 91 by structure not shown.

The transfer conveyor 94 receives the folded continuous coil row section 29 from the folding conveyors 90, 91. The transfer conveyor 94 is an endless chain link 89 conveyor having a plurality of coil supports 133. Each coil support 133 includes a pair 134 of vertically upstanding coil arms thereon, see FIGS. 10 and 14A. The transfer conveyor 94 extends from the folding station apparatus through the forming station apparatus. Each coil arm pair 134 includes a leading arm **134*a* and a trailing arm 134*b* adapted to abut a leading curve 35*a* and a trailing curve 35*b* of a loop 35 in a coil 12 so as to retain that coil in spaced parallel relation relative to the coil ahead of it and the coil behind it, see FIG. 10. The arms 134*a*, 134*b* of each pair are connected together by a hand plate 135 on which that same coil loop 35 is supported from underneath, to provide vertical support for the coil 12, see FIG. 14A. Hence, each coil support 133 on the transfer conveyor 94 includes a hand plate 135 and vertically upraised arms 134*a*, 134*b* that cooperate to embrace a single loop 35 of a coil 12** seated thereon so as to support the coil from underneath, as well as to prevent its forward or rearward movement relative to adjacent coils.

In operation of the folding station apparatus, and as the continuous length infeed helix section 30 is provided to that apparatus, front folding arm 90 causes the helix to oscillate toward the rear of the folding station apparatus so as to fold the helix and form a leading coil **12*x* therefrom, see solid line configuration of FIG. 10. Subsequently, the rear folding arm 91 oscillates toward the front of the apparatus in time relation with retraction of the front folding arm 90 so as to fold a trailing coil 12*y* from the infeed helix back parallel to the preceding station as partially illustrated in phantom lines in FIG. 10. In the meantime, the prior folded or leading coil 12*x* will be picked up by a pick-up foot 118 of the rear folding conveyor 93 and moved into spaced parallel relation with the coil 12*z* leading that coil 12*x* just so folded. Subsequently, the trailing coil 12*y* yet to be folded will be picked up by a pick-up foot 118 on the front folding conveyor 92. In this regard, note leading coil 12*x*′ in operational relation with rear folding conveyor 93 and trailing coil 12*y*′ in operational relation with front folding conveyor 92. Also, note only one pick-up foot 118 is used with each coil, that pick-up foot used being on the front folding conveyor 92 when there is no connector section between the coil 12*y*′ and its leading coil 12*x*′ in the front end plane 23 and that pick-up foot used being on the rear folding conveyor 93 when there is no connector section between the coil 12*x*′ and its leading coil 12*z*′ in the rear end plane 24. The pick-up feet 118 on the folding conveyors 92, 93 thus establish the coils 12 in the squarewave configuration 17 previously described, i.e., in spaced parallel axis 19 relation one with another, as they traverse the folding conveyors' capture paths 123. Further, the folding conveyors 92, 93 thus establish the three dimensional looped connector sections 14′,16′** between the coils so folded.

After the adjacent coils 12 have been disposed in the parallelism attitude, the folding conveyors 92, 93 convey the adjacent coils into operative proximity with the transfer conveyor 94, and the successive coil supports 133 on the transfer conveyor interengage successive spaced coils also as illustrated in FIG. 10. After a coil has been seated in a coil support 133, the folding conveyors' pick-up feet 118 angle outwardly away from the folded coil row section 29 so formed along the folding conveyors' release paths 124, thereby permitting the toes 121 of the folding conveyors' feet 118 to pass out from the looped connector sections 14′,16′ with which same were previously associated as the folding conveyors and transfer conveyor continue to move in the machine direction 34. This, of course, leaves the spaced parallel coils 12 in supported relation one with another on the transfer conveyor's coil supports 133 only.

Forming Station Apparatus

Figure 11:
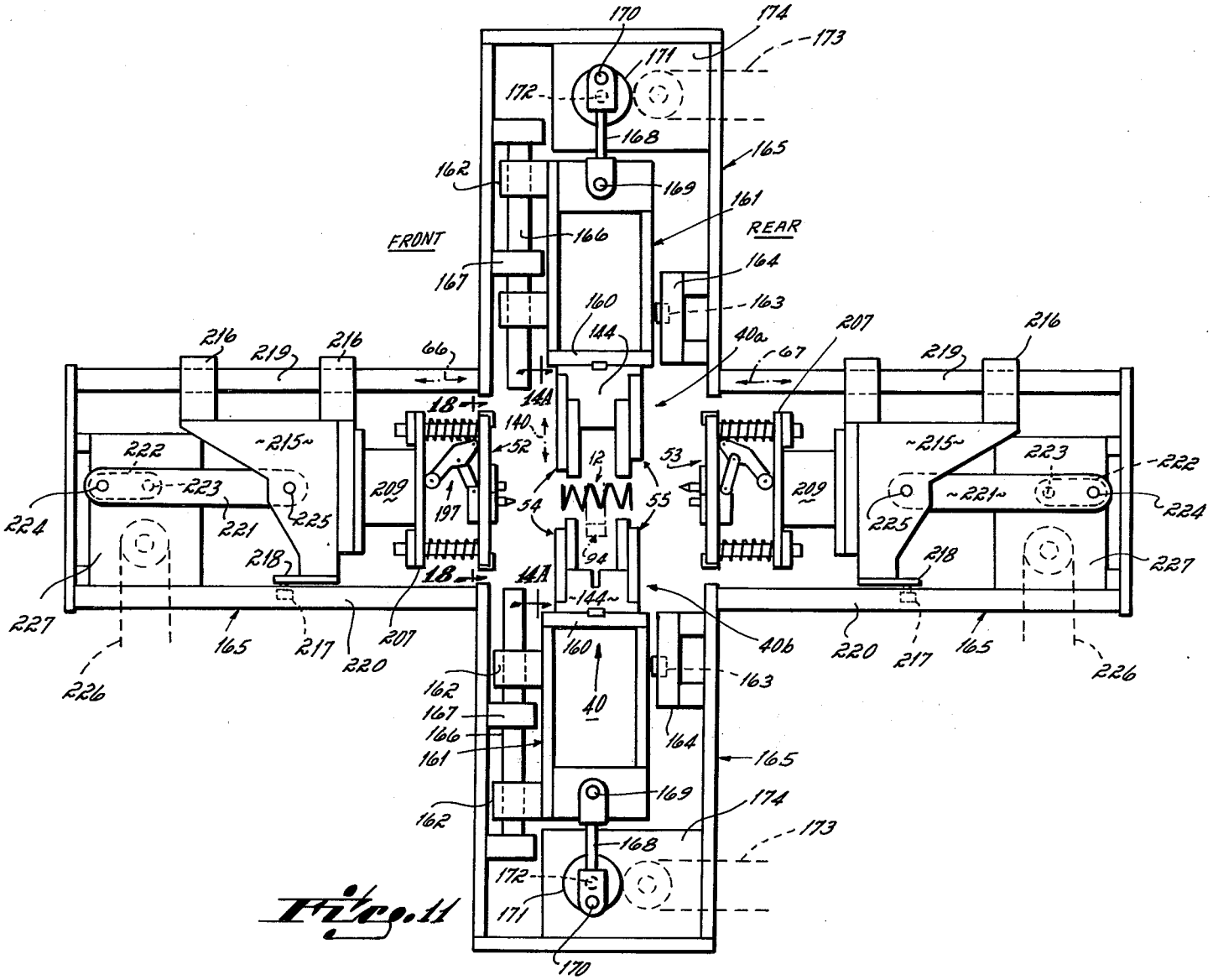
FIG. 11 is an end view of forming station structure in which the front end and rear end connector sections of the folded coil row are transformed from the three-dimensional looped attitude into the planar Z-shaped attitude.

The general layout of the forming station apparatus is particularly illustrated in FIG. 11. As shown in that Figure, the forming station apparatus includes the hold down die 40, that die having an upper die half **40*a* and a lower die half 40*b*. The hold down die 40 functions to grip selected front and rear end portions of three adjacent coils 12*a*1, 12*b*1, 12*a*2 so as to establish those coils in fixed relation one with another during formation of the planar z-shaped connector sections 14, 16 therebetween. The forming station apparatus also includes the front 52 and rear 53 forming heads. The front 52 and rear 53 forming heads are positioned in front of and to the rear of the hold down die 40, respectively, and each of those forming heads includes forming pins 56, 57 as previously discussed and illustrated in FIGS. 3-7B. The hold-down die 40 itself includes forming faces 64, 65 on the front and rear side faces thereof as illustrated in FIGS. 3–5, 12 and 13. These hold-down die forming faces 64, 65 cooperate with mating forming faces 62, 63 on the front 52 and rear 53 forming heads as illustrated in FIGS. 3–5, 19A, 19B, 21A, 21B. In general operation, the upper 40*a* and lower 40*b* hold-down die halves extend toward and retract away from one another relative to the folded coil row section 29 carried on the transfer conveyor 94, see phantom arrows 140. Further, the front 52 and rear 53 forming heads extend toward and retract away from the respective front and rear side forming faces 64, 64 defined by the upper 40*a*** and lower 40b hold-down die halves when those die halves are in hold-down or extended relation one with another, see phantom arrows 66,67.

Figure 12:
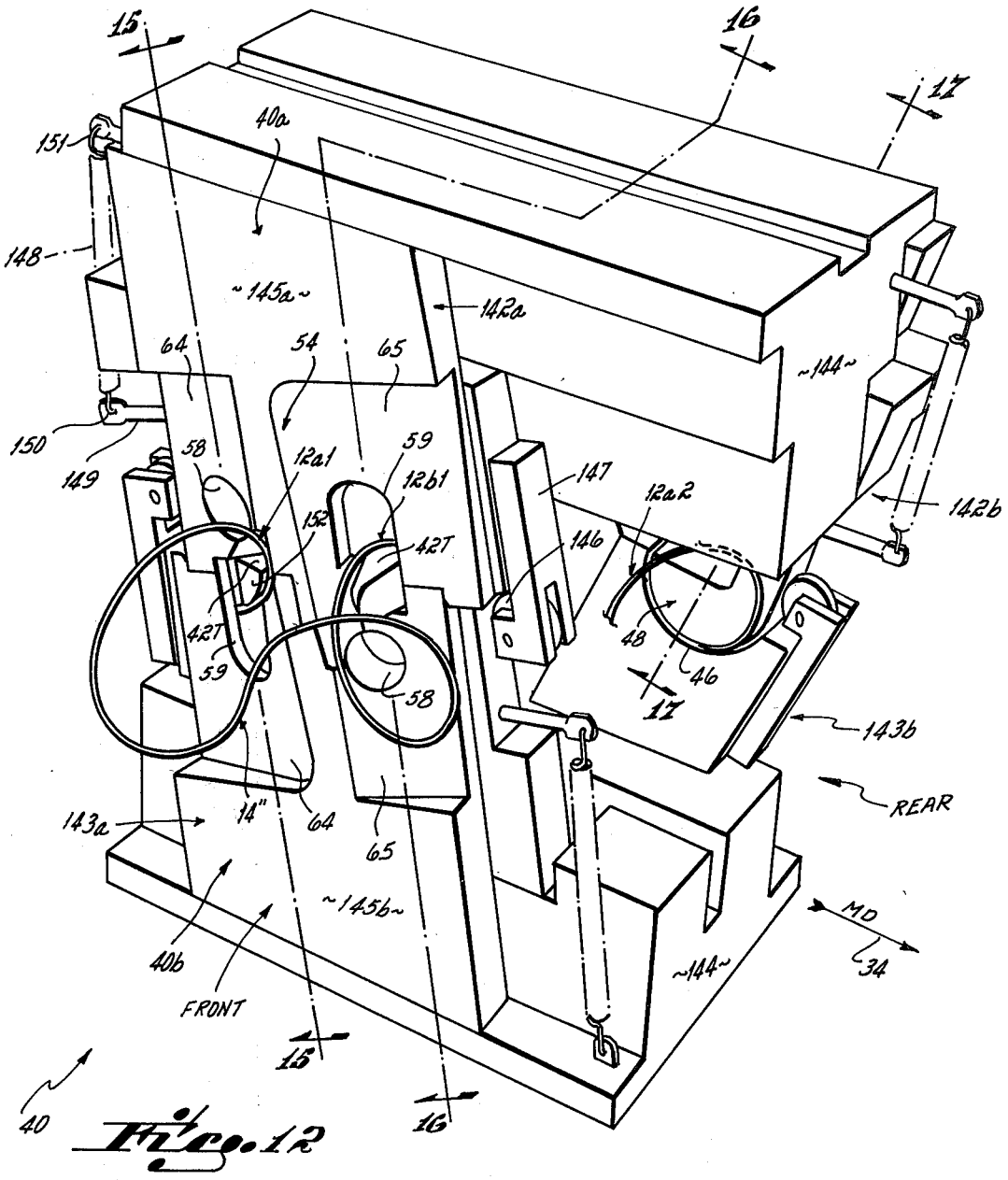
FIG. 12 is a perspective view of the hold-down die, in the closed position, in which adjacent spring coils are retained for transformation of connector sections from the three-dimensional looped attitude into the planar Z-shaped attitude.

The hold-down die 40 is particularly illustrated in FIGS. 12–17. The hold-down die, as shown in FIG. 12 from the front side thereof and as previously explained, is comprised of a top die half 40a and a bottom die half 40b, the die halves being shown extended into operational or hold-down position with adjacent coil springs 12a1, 12b1, 12a2 held therein and the three-dimensional looped connector sections 14", 16" connecting those adjacent coil springs. The hold-down die halves 40a, 40b, as shown in FIG. 13 from the front side thereof, are in the retracted or storage position also shown in FIG. 11, the phantom center lines 19'-19''' of trailing 12a1, center 12b1, and leading 12a2 coils, respectively being illustrated diagrammatically to show positioning of those coils with the die's hold-down arms 42, 43, 47, 48 and hold-down seats 41, 46.

The upper die half 40a includes a front top hold-down die assembly 142a and a rear top hold-down die assembly 142b, and the lower die half 40b also includes a front bottom hold-down die assembly 143a and a rear bottom hold-down die assembly 143b, see FIGS. 12-14A. In the upper die half 40a, each of the assemblies 142a, 142b is mounted to a central base block 144. The top front hold-down assembly 142a is comprised of a die block 145a that defines a hold-down seat 41 having an inside diameter equal to the outside diameter of the circular helix 30. An idler roller 146 fixed on bracket 147, which bracket is attached to the die block 145a, is cooperatively related with that seat 41. The seat 41, of course, defines the center line 19" for the center coil 12b1 of those three coils 12a1, 12b1, 12a2 held down by the hold-down die 40 at the same time, see FIG. 2A. The die block 145a also carries a hold-down arm 42 pivotally mounted thereto on pivot pin 42A. The hold-down arm 42 defines a rounded thumb section 42T of a diameter equivalent to the inside diameter of the spring coil adapted to be held down thereby, the thumb section being aligned with the seat 41 in the die block 145b of the bottom hold-down assembly 143a, (see also FIG. 16). The hold-down arm 42 is spring loaded toward the retracted or open position illustrated in FIGS. 13 and 14A, same being established by an operator arm 149 fixed to the hold-down arm that is connected with a tension spring 148 at one end 150, the other end 151 of the tension spring being fixed to the central base block 144. The hold-down arm's open or retracted attitude is defined by thumb surface 152 abutting stop surface 153 of the die block 145a. The top front die block 145a also includes the bore 58 for receiving stationary forming pin 56a therein, that bore being associated with the spring loaded hold-down arm 42 attached to that stock. The top front die block 145a also includes a slot 59 for receiving a movable forming pin 57b therein, that slot 59 being associated with the hold-down seat 41 defined in that block. Note further, and most particularly, that the leading 65 and trailing 64 outside surfaces of the top front die blick 145a are angled relative to the machine direction 34 of the coil row section 36 proceeding therethrough, the angle of each of those surfaces being about 15° relative to that machine direction to form an inwardly directed obtuse angle having its center point 78 midway between the center lines of adjacent coils 12a1, 12b1 (indicated by center lines 19', 19") served by that die block for reasons previously explained.

The top rear hold-down assembly 142b on the upper forming die half 40a is structured identical to the top front hold-down assembly 142a on that upper forming die half. However, the top rear assembly 142b is located in a reverse image position on the base mounting block 144, and is moved forwardly in the machine direction 34 relative to the top front assembly 142a so that the top front hold-down seat 41 and the top rear hold-down seat 46 lie on a common axis as indicated by phantom axis line 19", see FIGS. 13 and 14A. This positioning of the top rear hold-down assembly 142b relative to the top front hold-down assembly 142a results in the spring loaded hold-down arms 42, 48 being properly positioned to serve the trailing coil 12a1, and the leading coil 12a2, respectively, and results in the hold-down seats 41, 46 being properly positioned to serve the center coil 12b1, when the upper 40a and lower 40b die halves are extended in operational relation as explained in further detail below and as shown in FIGS. 14A-14D.

Figures 14A, 14B:
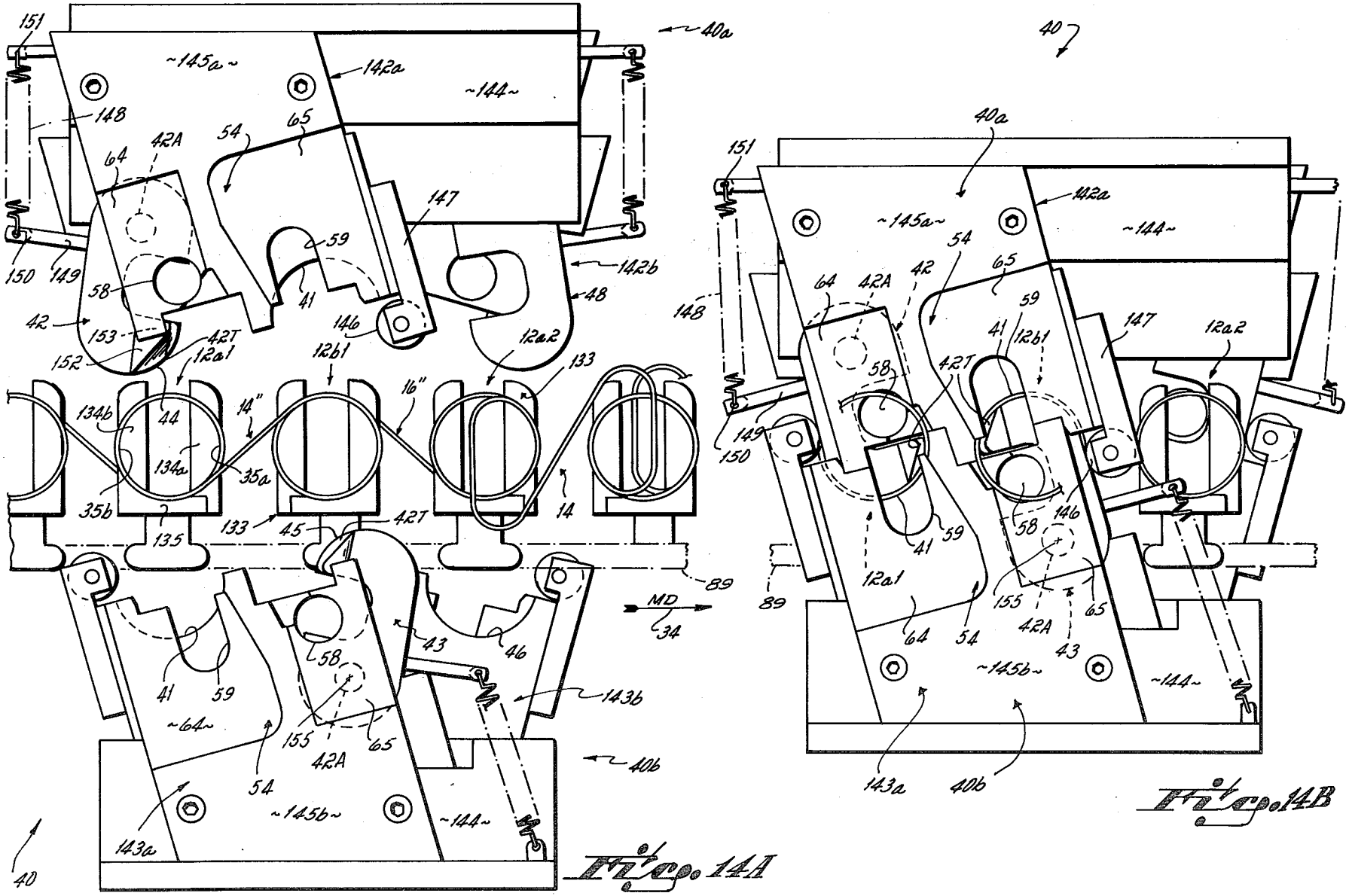
FIG. 14A is a front view illustrating the hold-down die in the open position and in receipt of leading, middle and trailing coil springs, prior to transformation of front end and rear end connector sections from the three-dimensional looped attitude into the planar Z-shaped attitude, taken on line 14A—14A of FIG. 11.
FIG. 14B is a view similar to FIG. 14A but showing the hold-down die in the closed or hold-down position.
Figure 14D:
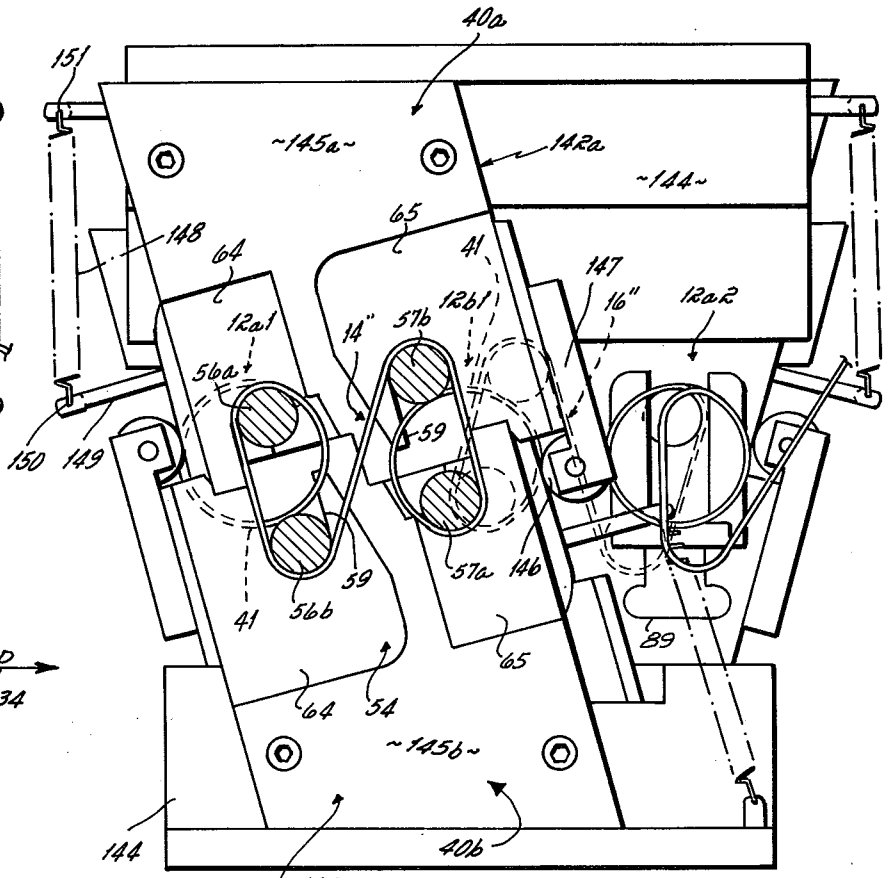
FIG. 14D is similar to FIG. 14C but showing the forming pins in the extended position for transforming the coils' connector sections into the Z-shaped attitude.
Figure 14C:
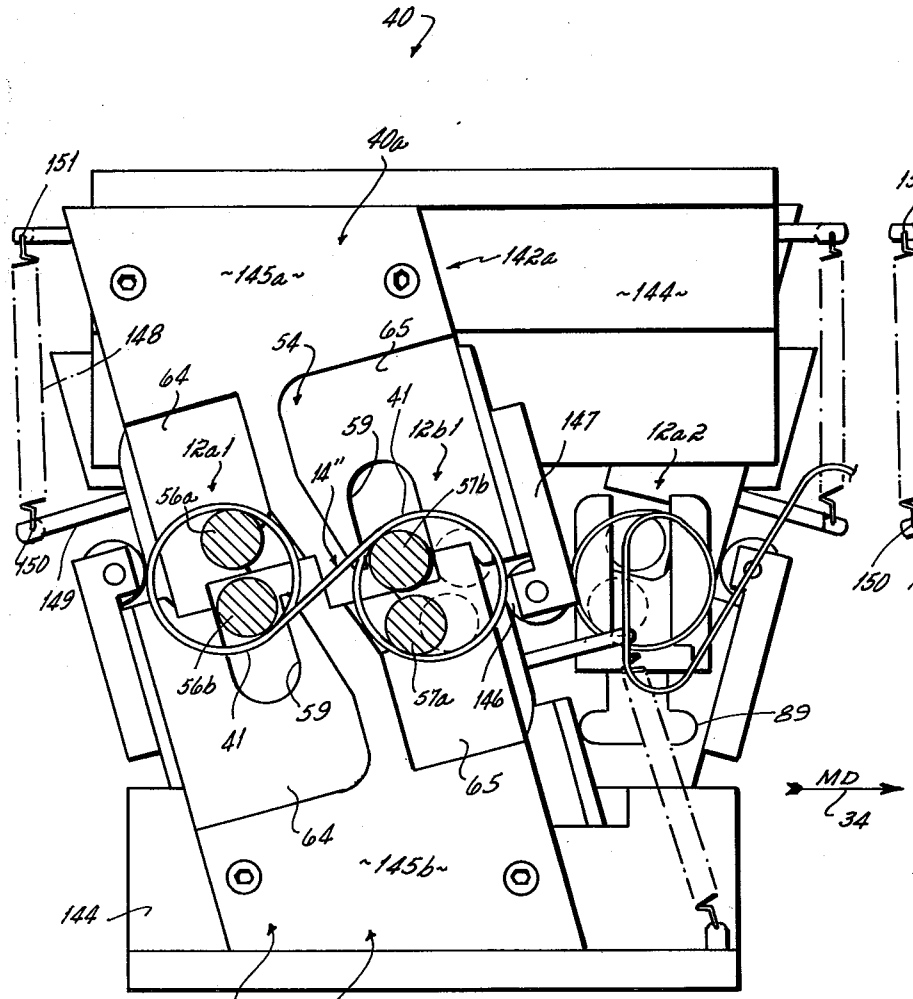
FIG. 14C is a view similar to FIG. 14B but showing insertion of forming pins into operative combination with the coils' connector sections and the hold-down die, those pins being in the retracted position.

The lower half 40b of the hold-down die is also comprised of bottom front 143a and bottom rear 143b hold-down assemblies, see FIGS. 13 and 14A. Each of the bottom front 143a and bottom rear 143b hold-down assemblies is of identical structure to the top front 142a and top rear 142b hold-down assemblies of the upper hold-down die half 40a. However, the spatial relationship or positioning of the front 143a and rear 143b hold-down assemblies of the lower hold-down die half 40b is different from that relation of the hold-down assemblies 142a, 142b in the upper hold-down die half 40a. In the lower hold-down die half 40b, the front 143a and rear 143b hold-down assemblies are positioned relative one to another, i.e., are fixed on the base block 144, so that the front 43 and rear 47 hold-down arms pivot on pins 42a which are on a common axis as indicated by phantom axis line 155, see FIG. 14A. This alignment of the lower die half's hold-down arms 43, 47 permits those arms to cooperate with the center line aligned hold-down seats 41, 46 of the upper hold-down die half when the upper die half 40a and lower die half 40b are extended to die forming relation, thereby permitting the hold-down die 40 to hold down a center coil 12b1 at both the front and rear ends thereof. This positioning of the bottom hold-down assemblies 143a, 143b relative one to the other also results in the hold-down seats 41, 46 of the bottom hold down die half 40b being located on either side of the hold-down arms 43, 47 (relative to the machine direction 34), thereby positioning those seats 41, 46 to receive the trailing hold-down arm 42 and the leading hold-down arm 48, respectively, of the top die half 40a when the hold-down die halves 40a, 40b are operationally positioned together in hold-down relation. This, of course, permits the hold-down die 40 at the front end thereof to hold down a trailing coil 12a1 and a leading coil 12a2 at the rear end thereof, see FIGS. 3 and 4.

In essence, therefore, the top hold-down die half 40a and the bottom hold-down die half 40b differ only one from the other by virtue of the position and orientation of the identical hold-down assemblies 142a, 142b, 143a, 143b associated therewith. In other words, the structure of front 142a, 143a and rear 142b, 143b hold-down assemblies on each of the hold-down die halves 40a, 40b is identical one with the other, and the front and rear hold-down assemblies on both of the hold-down die halves are identical one with another. However, the orientation or position of those hold-down assemblies 142a, 142b, 143a, 143b on the upper 40a and lower 40b die halves is different so as to permit operational relation of those hold-down die halves 40*a*, 40*b* one with another.

The upper 40*a* and lower 40*b* hold-down die halves are both connected with supporting framework by the same type mounting structure and are both operated in the same fashion by the same type drive structure. As shown in FIG. 11, and as to the lower hold-down die half 40*b*, that die half 40*b* is fixed on base plate 160 which is carried on framework 161. The hold-down die framework 161 includes two spaced bearing collars 162 located on one side thereof and a roller 163 on the other side thereof. The roller 163 is received between tracks 164 mounted to the machine base frame 165, and the collars 162 are received in sliding relation on guide shaft 166 fixedly connected to the machine base frame 165 by anchor brackets 167. The lower hold-down die half 40*b* is thereby adapted to reciprocate between the retracted position illustrated in FIGS. 11, 13 and 14A, and the extended or hold-down attitude illustrated in FIGS. 12 and 14B, as shown by phantom arrow 140.

The drive structure for retracting and extending the lower hold-down die half 40*b* includes a drive arm 168 pivotally mounted at one end 169 to the lower hold-down die half's framework 161. The drive arm 168 is rotationally mounted at the other end 170 to eccentrical plate 171 fixed to secondary drive shaft 172. The drive shaft 172 is connected with a chain 173 type drive connected to a continuously driven primaryy drive shaft, not shown, through a drive mechanism 174 of any known type adapted to translate continuous input drive from chain 173 into intermittent motion for the framework 161; such drive mechanisms are well known in the prior art. The chain 173 drive functions to extend and retract the lower hold-down die half 40*b* in timed relation with the upper hold-down die half 40*a*, and with the front 52 and rear 53 forming head, rotation of the secondary drive shaft 172 therefore being controlled by control mechanism, not shown.

In operation of the hold-down die 40, a series of three spring coils 12*a*1, 12*b*1, 12*a*2 are properly positioned in operational position with the hold-down die halves by the transfer conveyor 94 as illustrated in FIG. 14A. In this attitude the spring-loaded hold-down die arms 42, 43, 47, 48 of both die halves are positioned in the retracted attitude by tension springs 148 as shown in FIGS. 13 and 14A. Subsequently the upper hold-down die half 40*a* and the lower hold-down die half 40*b* approach one another vertically with the three adjacent coil springs 12*a*1, 12*b*1, 12*a*2 remaining stationary relative to the machine direction 34 and in that attitude shown in FIG. 14A. As the die halves 40*a*, 40*b* approach one another, the spring-loaded hold-down arms 42, 43, 47, 48 contact the cam rollers 146 associated with top and bottom hold-down seats 41 and 46, and the cam rollers cam those hold-down arms against the tension springs 148 into aligned and seated relation with the respective seats, as illustrated in FIGS. 14B and 12. Camming of the spring-loaded arms 42, 43, 47, 48 from the retracted or storage attitude shown in FIG. 14A into the use or hold-down attitude illustrated in FIG. 14B has been found necessary in order to interposition the hold-down relation with the spring coil loop 35 section on the seats 41, 46. With the hold-down die 40 properly closed, the three-dimensional looped connector section 14" that connects the center coil 12*b*1 and the trailing coil 12*a*1, and the three-dimensional looped connector section 16" that connects the center coil 12*b*1 and the leading coil 12*a*2, are adapted to be transformed into the Z-shaped planar connector configuration.

The front 52 and rear 53 forming heads are cooperatively engageable with die block 145*a*, 145*b* structure provided on the front and rear faces of the hold-down die halves 40*a*, 40 *b* when those halves 40*a*, 40*b* are in the closed or hold-down attitude as illustrated in FIGS. 11, 14B-17. The forming heads 52, 53 cooperate with the closed hold-down die 40 to translate the three-dimensional looped connector sections 14", 16" from that attitude into a two-dimensional Z-shaped attitude. The forming heads 52, 53 at the front and rear of the forming station apparatus are of identical structure one with another, and that structure is particularly illustrated in FIGS. 11 and 18-21.

Figure 18:
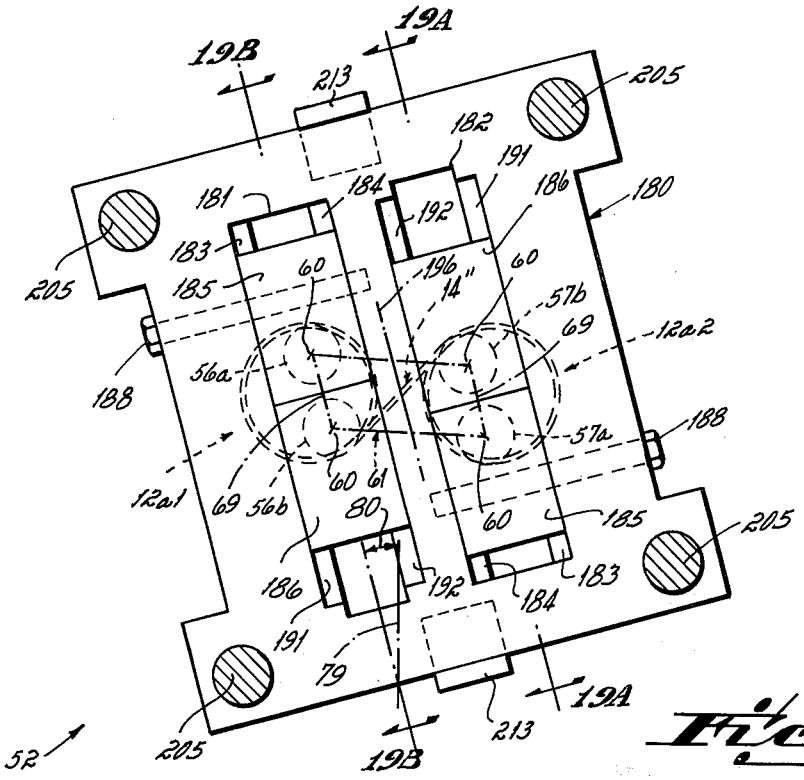
FIG. 18 is a front cross-sectional view taken along line 18—18 of FIG. 11 showing the front forming die, and hence the front forming pins, in the retracted position relative to a closed hold-down die.

The front-forming head 52 includes a pin mounting plate 180 provided with two slots 181, 182 therein, each of the slots being angled at an angle 80 of 15° relative to the vertical 79 as shown in FIG. 18. Each of the slots 181, 182 is provided with guide ribs 183, 184 and 191, 192 on opposed side edges thereof, and those guide ribs are adapted to receive pin blocks 185, 186, respectively, to which the stationary 56*a*, 57*a* and movable 56*b*, 57*b* pins are fixed, respectively. Note that the stationary pins 56*a*, 57*a* are pointed at the outer tips 187, and that the pin blocks 185 on which the stationary pins are fixed is each adapted to be selectively positioned at a fixed location in a vertical plane between minor limits, see FIG. 19A. The stationary pin blocks 185 are fixed in the desired position within the elongated slots 181, 182 in the pin mounting plate 180 along guide ribs 183, 184 by an adjustment bolt 188. The adjustment bolts 188 cooperate with small adjustment slots 189 in the stationary pin blocks 185 to permit limited position adjustment, vertically, along the guide ribs 183, 184 in the slots 181, 182. Also note that the movable pins 56*b*, 57*b* are blunt nosed at the outer tips 190, and the pin blocks 186 to which the movable pins are fixed are each adapted to reciprocate on guide ribs 191, 192 disposed at a slight inwardly-turned angle 195 (see guide rib center line 193) relative to the vertical 194, that angle being such that the movable pins 56*b*, 57*b* move slightly inward toward the center of the hold-down die 40 during operation thereof, see FIG. 19A. This angle 195 cooperates with a mating angle on each of the slotted surfaces 64 or 65 so that the connector loops to be flattened will assume a slight inward overbend while being held against the forming dies. This overbending will allow for the connector loop sections to retain a planar configuration when released. That pair of pin mounting blocks 185, 186 associated with pin pair 56*a*, 56*b* also defines a forming face 62 angled at a trailing angle 73*a* of about 15° relative to the machine direction 34, and that pair of pin mounting blocks 185, 186 associated with pin pair 57*a*, 57*b* defines a forming face 63 angled at a leading angle 73*b* of about 15° relative to the machine direction, see FIGS. 3, 19A and 19B. These pin block forming faces 62, 63 cooperate with forming faces 64, 65 on the front assemblies 142*a*, 143*a*.

Figure 19A:
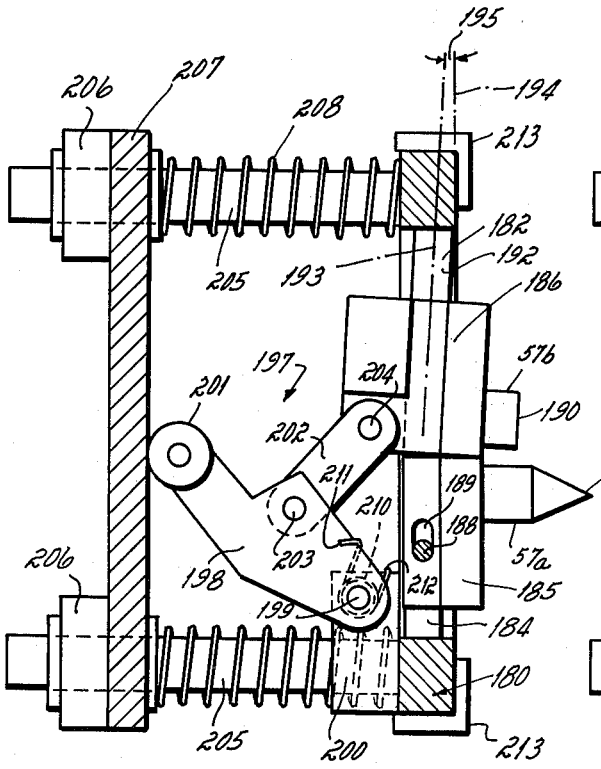
FIG. 19A is a cross-sectional view taken along line 19A—19A of FIG. 18.

As previously mentioned, the front 52 forming head includes two pairs 56 and 57 of forming pins, each pair including a stationary pin 56*a*, 57*a* and a movable pin 56*b*, 57*b*, and each pair of pins having their centers 60 disposed on a line 69*a*, 69*b* that defines a 15° angle 80 with the vertical 79 as illustrated in FIGS. 6A, 6B and 18. However, the pin pairs 56, 57 are disposed in reverse image fashion relative to a center plane 196 disposed parallel between the center lines 69*a*, 69*b* that include the center axes 60 of each pin pair 56, 57. And in this connection, it is preferred that the pin pairs 56, 57 be so disposed that the movable pin **56*b*, 57*b* of each pair cooperates with each other to form the angle leg 179 of the Z-shaped connector 14 configuration, thereby permitting the fixed pins 56*a*, 57*a* of each pair to remain in alignment with the coils' outer periphery so that the Z-shaped connector section 14, in effect, formed about those fixed pins 56*a*, 57*a* by the movable pins 56*b*, 57*b*. This structural relation is particularly illustrated in FIGS. 6A and 6B vis-a-vis FIGS. 7A and 7B, and in FIG. 18 vis-a-vis FIG. 19. As shown in FIGS. 18 and 19A, and for the left-hand pair 56 of pins on the front-forming head 52, the stationary pin 56*a* is positioned above the movable pin 56*b*. The reverse image positioning of the stationary 57*a* and movable 57*b* pins is disclosed for the right-hand pin pair 57 of the front-forming head 52, that reverse image structure being illustrated in FIGS. 18 and 19B**.

Figure 19B:
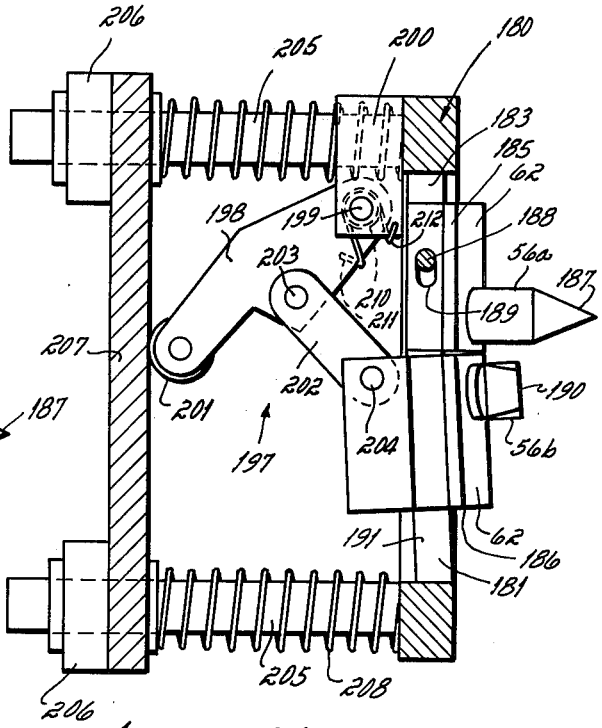
FIG. 19B is a cross-sectional view taken along line 19B—19B of FIG. 18.
Figure 20:
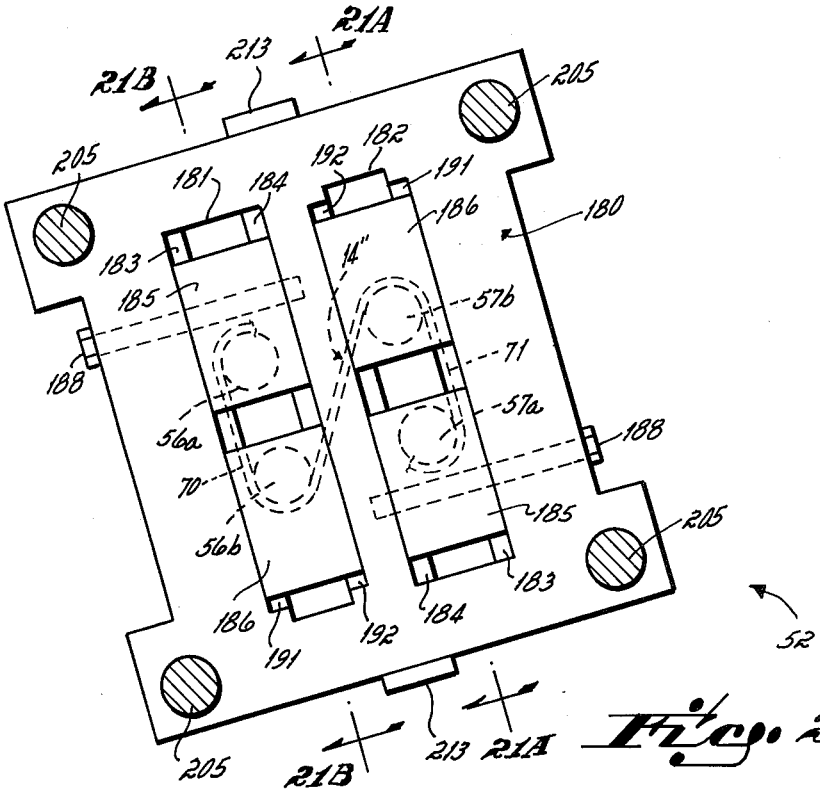
FIG. 20 is a front cross-sectional view similar to FIG. 18 but showing the front forming die, and hence the front forming pins, in the extended position relative to the hold-down die.
Figure 21A:
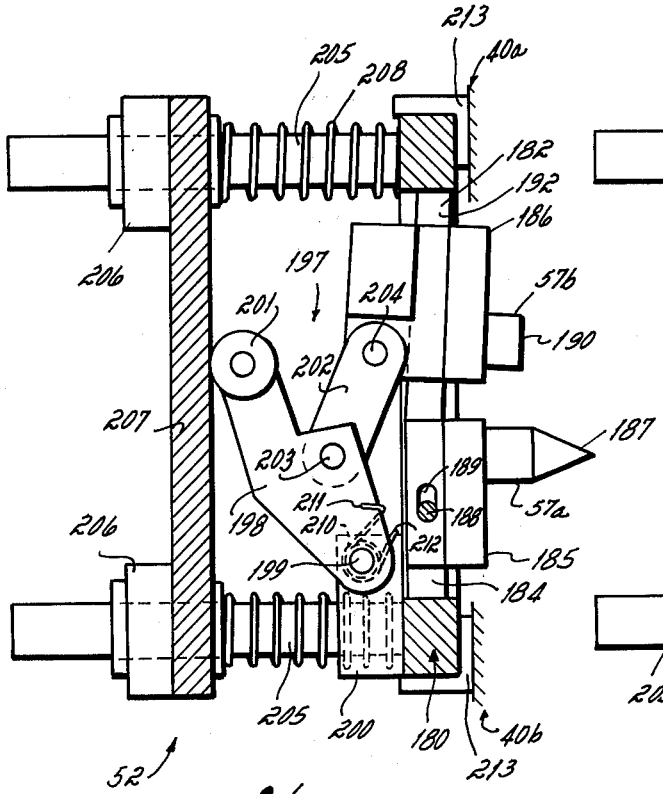
FIG. 21A is a cross-sectional view taken along line 21A—21A of FIG. 20.
Figure 21B:
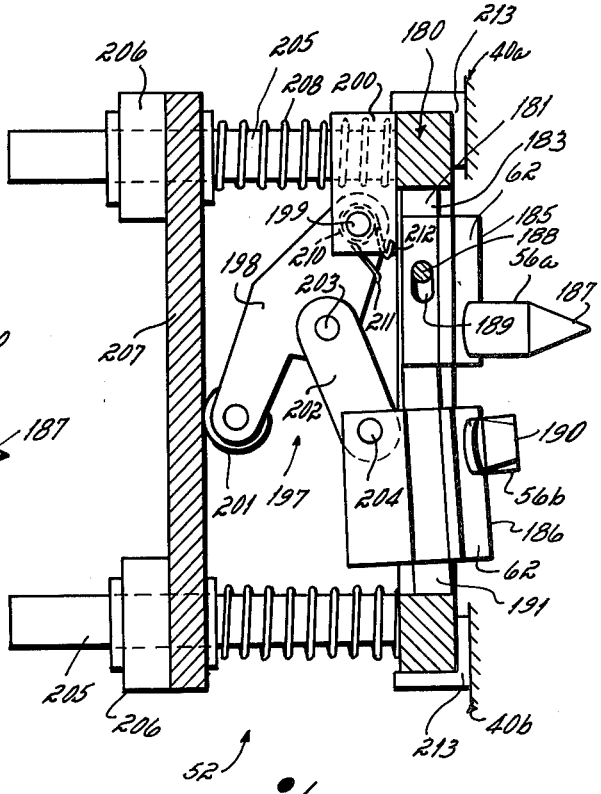
FIG. 21B is a cross-sectional view taken along line 21B—21B of FIG. 20.

The movable pins **56*b*, 57*b* are each movable by a pin block drive linkage 197 that is part of the front-forming head 52, see FIGS. 18 and 19A. Each pin block drive linkage 197 includes a pin drive arm 198 pivotally mounted as at 199 to bracket 200 fixed to the pin mounting plate 180. The drive arm 198 includes a cam roller 201 disposed at the free end thereof. The drive arm 198 is connected with the movable pin mounting block 186 by a drive link 202 pivotally connected at one end 203 intermediate the ends of the drive arm and at the other end 204 to the movable pin mounting block. Four connector posts 205 are also mounted at one end to the pin-mounting plate 180 at the four corners thereof. Each of the connector posts 205 includes a stop collar 206 fixed at the other end, the collars being adapted to cooperate with a press plate 207 through which the connector posts pass. The press plate 207 itself is fixed immobily to part of a carriage 209 for that front-forming head 52, the carriage being explained in further detail below. Compression springs 208 are interposed between the press' plate 207 and the pin-mounting plate 180 around each of the posts 205, thereby continuously springloading the pin-mounting plate 180 into the extended attitude relative to the press plate, as illustrated in FIGS. 19A and 19B, when the front-forming head 52 is in the retracted or storage attitude. In the retracted position shown in FIGS. 19A and 19B, it will be noted the movable pin drive arm 198 is sized such that the cam roller 201 rests against the inner surface of the press plate 207. A torsion spring 210 around pivot shaft 199 of the movable pin drive arm 198, and connected at one end 211 to the drive arm 198 and at the other end 212 to the mounting bracket 200, continuously spring biases the movable pin drive arm toward the retracted attitude shown in FIGS 19A and 19B. Further, note particularly the pin-mounting plate 180 is provided with stop pads 213 on the top and bottom edges thereof, the stop pads cooperating with the hold-down die 40 for limiting inward motion of the front-forming head 52**.

The structure of the rear-forming head 53 is identical to the structure of the front-forming head 52 except that the 15° angulation of the rear head's component is reversed from that of the identical front head's component when viewed from the forming station's front and relative to the machine direction, see FIG. 6B relative to FIG. 6A. This reverse angulation permits the front 52 and rear 53 forming heads to cooperate with the front 54 and rear 55 forming plates, which plates are likewise provided with opposite 15° angulation as explained earlier. Further, and importantly, the rear-forming head is spaced longitudinally (relative to the machine direction 34) upstream of the front-forming head 52 so it can operatively cooperate with the rear-forming plate 55 which is likewise spaced longitudinally upstream of the front-forming plate 54, see FIGS. 3–5.

The front 52 and rear 53 forming heads are both connected with supporting framework by the same type mounting structure, and are both operated in the same fashion by the same type drive structure, see FIG. 11. With respect to the front-forming head 52, that head is fixed to a movable carriage 215 mounted in the framework 165 of the forming station apparatus. The carriage 215 includes a mounting block 209 fixed to the press plate 207, thereby connecting the forming head 52 and the carriage. The front-forming head 52 is adapted to extend into and retract from the forming attitude (shown in FIGS. 5, 14D, 20, 21A and 21B) in a linear travel path 66 that is parallel to ground, i.e., horizontal. The front-forming head's carriage 215 is provided with a pair of journal sleeves 216 on the top thereof, and a guide roller 217 fixed to a bottom foot 218 thereof. The journal sleeves 216 are carried on a shaft 219 that is fixed to the forming station framework 165. The guide roller 217 is disposed in tracks (not shown) defined in structural element 220 of the forming station framework 165.

The front-forming head's carriage 215 is connected by connector rod 221 and an eccentric arm 222 with drive shaft 223, the eccentric arm being fixed to the drive shaft. The connector rod 221 is rotationally connected as at 224 to the eccentric arm 222, and is pivotally connected as at 225 to the carriage 215. The output drive shaft 223 is driven through a drive mechanism 227 of any known type adapted to translate continuous input drive from input chain 226 into intermittent motion for the carriage; such drive mechanisms 227 are well known in the prior art. The input drive chain 226 is connected with a continuously driven main drive shaft, not shown. The drive mechanisms 227 for the front 52 and rear 53 forming heads are provided in timed relation with the drive mechanisms 174 for the hold-down die halves **40*a*, 40*b***, thereby extending and retracting all the forming heads and die halves in intermittent and timed fashion.

Figure 15:
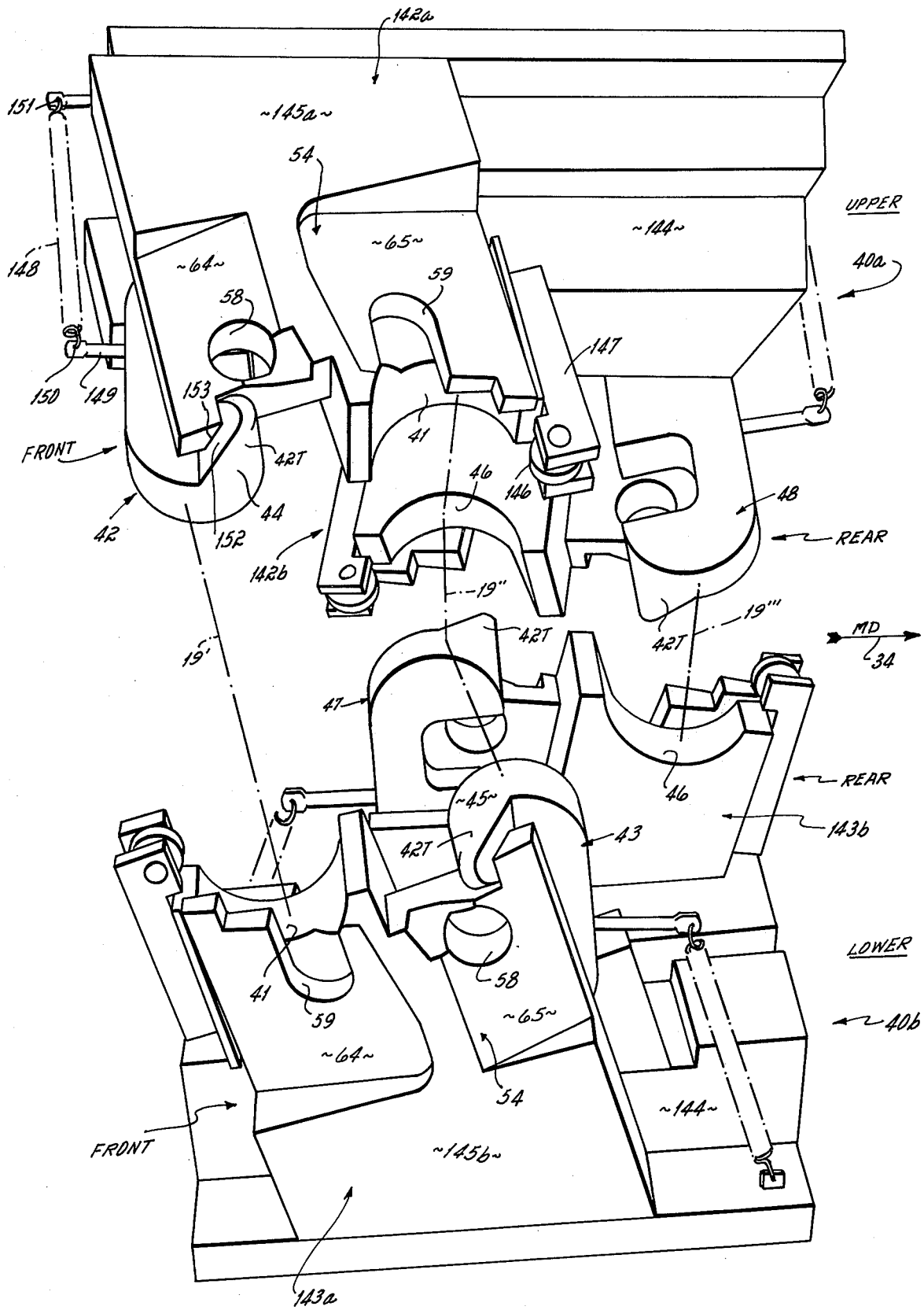
FIG. 15 is an end cross-sectional view taken along line 15—15 of FIG. 12 showing the front forming die in the retracted position relative to the closed hold-down die.

In operation of the forming die heads 52, 53, it is necessary that the hold-down die 40 be first positioned in the hold-down attitude illustrated in FIGS. 12, 14B and 16 so that the three adjacent spring coils, i.e., the leading coil **12*a*2, the center coil 12*b*1 and the trailing coil 12*a*1 are all properly held in hold-down relation prior to commencement of forming, at the same time, the three-dimensional looped connector sections 14″, 16″. As previously mentioned, and in this hold-down attitude, the middle coil 12*b*1 is held down at both the front and rear ends thereof as illustrated particularly in FIG. 16, the leading coil 12*a* 2 is held down at the rear end thereof only as shown in FIG. 17, and the trailing coil 12*a*1 is held down at the front end thereof only as shown in FIG. 15. In this hold-down position, therefore, one pair of coils (namely, the trailing coil 12*a*1 and the middle coil 12*b*1) are held down so the spring wire connector section 14″ interconnecting those two coils can be transformed from the three-dimensional looped attitude into the planar Z-shaped attitude. Further in this hold-down position, the three-dimensional looped connector section 16″ which connects the held-down pair of coils (namely, the center coil 12*b*1 and coil 12*a*2**)

with a downstream pair of coils 12a2, 12b2 (only the adjacent coil 12a2 of which is held down) is also transformed from the three-dimensional looped attitude into the Z-shaped connector attitude.

After the hold-down die 40 has been brought together into the FIGS. 12, 14B and 16 attitude, it is apparent, as shown particularly in FIGS. 14C and 15-17, that the stationary 56a, 57a and movable 56b, 57b pins carried by the forming heads 52, 53 are aligned with the three-dimensional connector loop sections 14'', 16'' because of the position at which the closed hold-down die is disposed relative to the position of the retracted forming heads 52, 53. Thereafter, the front 52 and rear 53 forming heads are moved toward the front 54 and rear 55 forming plate, respectively, of the hold-down die 40 so as to initially dispose the stationary 56a, 57a and movable 56b, 57b forming pins in the respective bores 58 and slots 59 provided in the forming plates on the hold-down die halves 40a, 40b, see FIGS. 5 and 14C. Continued movement of the front and rear forming heads' press plates 207 (by drive mechanisms 227) after the front 52 and rear 53 forming heads achieve the FIG. 5 attitude results in the movable pins 56b, 57b being moved from FIGS. 18 and 19 attitude into the FIGS. 20 and 21 attitude. The pins 56b, 57b are so extended by the movable pin drive arms 198 in response to the force exerted by the press plates 207 after the stop pads 213 engage the exterior surfaces of the hold-down die 40 to stop the inward movement of the pin mounting plates 180 which occurs when the pin mounting blocks 186 have facially engaged the three-dimensional looped connector sections 14'', 16'' against the forming plates 54, 55 of the holding die 40. In other words, and once the FIG. 5 attitude has been obtained, continued movemnet of the press plates 207 causes the movable forming pins 56b, 57b to move downwardly or upwardly, as the case may be, within the front 54 and rear 55 forming plates. This respective upward and downward movement of the movable forming pins 56b, 57b on each forming head 52, 53 transforms the spring wire connector sections 14'', 16'' into a Z-shaped configuration as illustrated in FIGS. 7A, 7B, 14D and 20. The operation of the forming heads 52, 53, hence, is first to locate the movable 56b, 57b and stationary 56a, 57a pins within the forming plates 54, 55 slots and bores as shown in FIGS. 5, 6A, 6B, 14C and 18. Simultaneously, the forming surfaces 62, 63 on the front 52 and rear 54 forming heads press the connector sections 14'' and 16'' between those faces and the forming faces 64, 65 on the hold-down die 40 as shown in FIG. 5. Subsequently, continued forward movement of the forming heads' press plates 207 force the movable forming pins 56b, 57b upwardly or downwardly, as the case may be, to translate the connector sections 14'', 16'' into Z-shaped configuration as shown in FIGS. 7A, 7B, 14D and 20.

When the forming heads 52, 53 and the hold-down die halves 40a, 40b are retracted into the storage attitude illustrated in FIG. 11, the Z-shaped connector sections 14, 16 so formed are of generally planar configuration, see FIGS. 8, 9A and 9B.

Having described in detail the preferred embodiment of my inventions, what I desire to claim and protect by Letters Patent is:

1. A method for forming a row of spring coils from a continuous length of spring wire, said method comprising the steps of forming a helix of continuous length from said continuous length of spring wire, thereafter folding said continuous length helix into a wave-like configuration for providing a plurality of spring coils in a coil row, each of said coils being connected at one end with an adjacent coil to one side thereof by one connector section and being connected at the other end with an adjacent coil to the other side thereof by another connector section, each of said connector sections being disposed in a three-dimensional looped attitude in said folding step, and thereafter forming each of said connector sections into a desired configuration from that three-dimensional looped attitude established in said folding step, said forming step being performed after said folding step has been performed.

2. A method as set forth in claim 1, each of said connector sections being formed into a planar configuration.

3. A method as set forth in claim 2, each of said connector sections also being formed into a generally Z-shaped configuration.

4. A method as set forth in claim 1, said continuous length helix being folded so as to establish each spring coil's center line generally parallel to the center lines of adjacent spring coils so as to establish each spring coil of a length generally equal the length of adjacent spring coils, thereby providing a folded coil row of generally square wave configuration.

5. A method as set forth in claim 1, each of said connector sections being of a length approximately equal to the length of a single loop of said continuous length helix.

6. A method as set forth in claim 5, each of said spring coils being comprised of a number of helical loops equal to a unit number plus one-half.

7. A method as set forth in claim 1, said folding step including the step of oscillating said continuous length helix from a point located on a phantom center line of said coil row, the oscillation arc being generally equal in length to the center line length of said spring coils.

8. A method as set forth in claim 7, said forming step including the steps of holding down a center coil at both ends thereof, holding down a leading coil at one end thereof, and holding down a trailing coil at an end thereof opposite to that end at which said leading coil is held down, prior to forming said connector sections but after folding said continuous length helix.

9. A method as set forth in claim 2, said forming step including the step of orienting said connector sections into a generally V-shaped attitude in response to forming forces exerted thereon, thereby permitting said connector sections to spring back into a generally planar attitude after release of said forming forces.

10. A method as set forth in claim 3, said forming step including the step of angling said Z-shaped connector sections' legs at one end of each spring coil in one direction, and angling said Z-shaped connector sections' legs at the other end of said coil in the other direction, relative to the center line of said coil in response to forming forces exerted thereon, thereby permitting each Z-shaped connector section's legs to spring back into a generally perpendicular position relative to the center line of said coil upon release of said forming forces.

11. Apparatus for forming a row of spring coils from a continuous length of spring wire, said apparatus comprising means for forming a helix of continuous length from a continuous length of spring wire, means for folding said continuous length helix into a wave-like configuration for providing a plurality of spring coils in a coil row, each of said coils being connected at one end with an adjacent coil to one side thereof by one connector section and being connected at the other end with an adjacent coil to the other side thereof by another connector section, each of said connector sections being disposed in a three-dimensional looped attitude after said folding, and means for forming each of said connector sections of said folded continuous length helix into a generally planar configuration from that three-dimensional looped attitude established in said folding step.

12. The apparatus of claim 11 wherein said folding means is operable to form each of said connector sections into a generally planar Z-shaped configuration.

13. The apparatus of claim 11 wherein said folding means is operable to form said continuous length helix to a condition in which each spring coil's center line is generally parallel to the center lines of adjacent spring coils and each spring coil is of a length generally equal the length of adjacent spring coils, thereby providing a folded coil row of generally square wave configuration.

14. The apparatus of claim 11 wherein said forming means comprises means for holding down a center coil at both ends thereof, means for holding down a leading coil at one end thereof, means for holding down a trailing coil at an end thereof opposite to that end at which said leading coil is held down, and means for applying a stress beyond the elastic limit of said wire while said ends of said coils are so held so as to form said connector sections into a generally planar configuration.

15. The apparatus of claim 11 wherein said forming means comprises means for displacing said connector sections through and beyond a planar attitude in response to forming forces exerted thereon, thereby permitting said connector sections to spring back into a generally planar attitude after release of said forming forces.

16. The apparatus of claim 12 wherein said forming means comprises means for angling said Z-shaped connector sections' legs at one end of each spring coil in one direction, and means for angling said Z-shaped connector sections' legs at the other end of said coil in the other direction, relative to the center line of said coil in response to forming forces exerted thereon.

17. The apparatus of claim 16 wherein said angling means is operable to overstress the angle of said Z-shaped connector sections so as to permit each Z-shaped connector sections' legs to spring back into a generally perpendicular position relative to the center line of said coil upon release of said forming forces.

18. The apparatus of claim 11 wherein said folding means comprises folding arm structure positioned to cooperate with said helix for folding multiple coils from said helix, a folding conveyor having a first run adapted to cooperate with first ends of the coils in the coil row, and a second run adapted to cooperate with second ends of the coils in the coil row, said first and second conveyor runs being associated in operational relation with said folding arm structure for restraining adjacent coils in the desired row configuration relative one to the other, said first and second conveyor runs being operational in a path that defines a first plane, and a transfer conveyor adapted to receive the folded coil row from said folding conveyor, said transfer conveyor being disposed in a second plane generally perpendicular to said first plane, said transfer conveyor being structured to restrain said wire coils in that same spatial relation established by said folding conveyor.

19. The apparatus of claim 18 wherein said folding arm structure includes first and second folding arms operable in timed relation with said folding conveyor, said first folding arm cooperating with said spring wire helix for folding a leading spring wire coil from that helix, and said second folding arm cooperating with said helix to form a trailing spring wire coil from that helix, thereby establishing successive pairs of coils from said helix in connected relation one with the other.

20. The apparatus as set forth in claim 19, wherein said folding arms are of a length established to provide the desired length of said wire coils.

21. The apparatus as set forth in claim 18, further comprising two sets of pick-up feet connected to said folding conveyor, a first set of feet being spaced on said first run to engage one end of alternate wire coils established by said folding arms, and a second set of feet being spaced on said second run to engage the other end of those wire coils not served by said first set of feet.

22. The apparatus as set forth in claim 18, wherein said folding conveyor is disposed in a generally horizontal plane and said transfer conveyor is disposed in a generally vertical plane.

23. The apparatus as set forth in claim 21, wherein said first and second sets of feet are disposed to run parallel within a wire coil capture path defined by said folding conveyor and disposed in said first plane, and being adapted to traverse a release path away from engaged relation with said coil row after said coil row has been picked up by said transfer conveyor.

24. The apparatus as set forth in claim 18 wherein said transfer conveyor comprises multiple coil arm pairs connecting to said transfer conveyor, the leading arm of each coil arm pair contacting the leading curve of a coil loop in a wire coil, and the trailing arm of that coil arm pair contacting the trailing curve of a coil loop in that same wire coil, to retain said coils in spaced relation relative one to another as established by said folding arm structure and said folding conveyor.

25. The apparatus as set forth in claim 24, said transfer conveyor further comprising a hand plate associated with each of said coil arm pairs to support a wire coil from beneath said coil.

26. The apparatus of claim 11 wherein said forming means comprises a hold-down die having two halves, said halves being movable between hold-down and retracted positions, and said halves being structured to grip at least two adjacent coils in hold-down relation one with another at the same ends of said adjacent coils, a forming face defined on one side of said hold-down die, said forming face being partially carried on each half of said hold-down die, said connector section being disposed in forming relation with said forming face when said adjacent coils are held down by said hold-down die, and a forming head movable between forming and retracted positions relative to said hold-down die's forming face, said forming head including a forming face structured to cooperate with said hold-down die's forming face in the forming position of said forming head, cooperation between said hold-down die's forming face and said forming head's forming face being adapted to conform said connector section disposed therebetween into the desired configuration.

27. The apparatus as set forth in claim 26 further comprising structure for said hold-down die for gripping a leading and a center wire coil at one end thereof, and said center and a trailing coil at the other end thereof, said hold-down die thereby being structured for restraining three adjacent coils in hold-down relation therebetween, a forming face on each side of said hold-down die, each of said forming faces being partially carried on each half of said die, the connector section of said leading and center coils being disposed in forming relation with said hold-down die's forming face on one side if said hold-down die when said coils are held down, and the connector section between said center and trailing coils being disposed in forming relation with the hold-down die's forming face on the other side of said hold-down die when said coils are held down, and a forming head movable between forming and retracted positions for cooperable engagement with each of said hold-down die's forming faces, each of said forming heads including a forming face structured to cooperate with one of said hold-down die's forming faces in the forming position for conforming both of said connector sections to the desired configuration.

28. The apparatus as set forth in claim 26 wherein said hold-down die forming face and said forming head forming face are structured to establish said connector section in a generally planar configuration.

29. The apparatus as set forth in claim 28 wherein said hold-down die's forming face and said forming head's forming face each define a V-shape of the same general configuration, and operative to overbend said connector section during forming so that said connector section springs back to a generally planar attitude after forming.

30. The apparatus as set forth in claim 28 wherein said hold-down die's forming face and said forming head's forming face are structured to form said connector section into a generally Z-shaped configuration.

31. The apparatus as set forth in claim 26 further including at least one forming pin providing on one of said hold-down die and said forming head, said pin being adapted to cooperate with said connector section for translating said section into a desired planar configuration upon said forming head being moved into the forming position with said hold-down die.

32. The apparatus as set forth in claim 31, including a pair of forming pins, one pin of said pair being movable and one pin of said pair being stationary.

33. The apparatus as set forth in claim 32 wherein said stationary pin of said pair is received in a bore defined in that forming face of said hold-down die and said forming head on which said pin is not mounted, and said movable pin is received in a slot defined in that forming face of said hold-down die and said forming head on which said pin is not mounted.

34. A hold-down die for holding adjacent end sections of adjacent parallel spring wire coils comprising a first die half, and a second die half, said die halves being movable between retracted and hold-down attitudes, a hold-down seat for each coil defined on at least one of said die halves, a hold-down arm receivable in each hold-down seat, said hold-down arm being mounted to that hold-down die half in which its associated hold-down seat is not defined, said hold-down arms and hold-down seats being adapted to grip at least a part of a loop of each parallel coil at the same end thereof, and drive means for extending and retracting said die halves relative one to another between said retracted and hold-down attitudes.

35. A hold-down die as set forth in claim 34 including pivot mount means connecting said hold-down arms with said hold-down die, spring means adapted to bias continuously each of said hold-down arms into a retracted attitude, and cam surface means associated with each of said seats, said cam surface means being adapted to bias said hold-down arms into operational relation with said hold-down seats upon closure of said first and second die halves into said hold-down attitude, thereby permitting said hold-down arms to clear coil loops adjacent to those coil loops with which said hold-down arms cooperate.

36. A hold-down die as set forth in claim 35, the inside radius of each hold-down seat being approximately equal to the outside radius of a wire coil, and the outside radius of each hold-down arm being approximately equal to the inside radius of each wire coil.

37. A hold-down die as set forth in claim 34 including a forming face partially carried by said first die half and partially carried by said second die half, said forming face being adapted to cooperate with a forming head when said hold-down die is in the hold-down attitude.

38. A hold-down die as set forth in claim 37, said hold-down die's forming face including structure adapted to cooperate with forming pins carried by said forming head.

39. A hold-down die as set forth in claim 35, a hold-down seat being defined in each die half and a hold-down arm being connected to each die half.

40. A hold-down die as set forth in claim 39, each die half defining at least two hold-down seats and at least two hold-down arms pivotally mounted thereto, one hold-down seat and one hold-down arm being provided on one side of each die half and the other hold-down seat and hold-down arm being provided on the other side of each die half, said hold-down arms and hold-down seats being oriented to hold down a leading coil at one end, a center coil at both ends, and a trailing coil at the other end.

41. A forming head for transforming a three-dimensional looped connector section between adjacent spring wire coils into a desired configuration, said apparatus comprising a first forming face and at least one pair of forming pins, said forming face and forming pins being cooperable with a second forming face, and at least one of said forming pins being movable relative to said first forming face, first drive means for extending and retracting said first forming face and forming pin pair relative to said second forming face into and out of compressive relation with said looped connector section, said drive means also serving to locate said forming pin pair into functional relation with said connector section, and second drive means for moving at least one pin of said forming pin pair relative to the other pin of said forming pin pair after said pins have been disposed in functional relation with said connector section, said first forming face and forming pin pair cooperating with said second forming face to provide said connector section in the desired configuration.

42. A forming head as set forth in claim 41 in which said first and second forming faces are structured to establish said connector section in planar configuration.

43. A forming head as set forth in claim 42 in which said first and second faces each define a V-shape of generally the same angular configuration, thereby overbending said connector section upon compression of said section therebetween so that said section springs back to the planar attitude upon removal of said connector section from cooperative relation therewith.

44. A forming head as set forth in claim 42 in which said pins cooperate to provide said connector section in a generally Z-shaped configuration.

45. A forming head as set forth in claim 44 including two pair of forming pins, one pin of each pair being movable and one pin of each pair being stationary.

46. A forming head as set forth in claim 45, each pin pair being disposed on a center line oriented about 15° relative to a plane that includes the center line of said adjacent coils, the pin pair center lines being disposed parallel one to the other.

47. A forming head as set forth in claim 42 in which said second drive means is operable only after said first and second forming faces have been disposed in compressive relation relative one to the other.

48. A forming head as set forth in claim 47, said second drive means including pin blocks carried in a pin mounting plate, one pin block being movable and the other being stationary, said movable pin block mounting said movable forming pin and said stationary pin block mounting said stationary mounting pin, a press plate movable relative to said pin mounting plate, said first drive means being connected to said press plate, and a pin block drive linkage connecting said press plate and said movable pin block, said pin block drive linkage being activated only after said first and second forming faces have been placed in compressive relation relative one to another.

49. A forming head as set forth in claim 48, said second drive means further including first spring means normally spring loading said press plate away from said pin mounting plate, and second spring means spring loading said pin block drive linkage normally to a home position.

* * * * *

UNITED STATES PATENT AND TRADEMARK OFFICE

CERTIFICATE OF CORRECTION

PATENT NO. : 4,112,726

DATED : September 12, 1978

INVENTOR(S) : E. E. Adams, et al

It is certified that error appears in the above—identified patent and that said Letters Patent is hereby corrected as shown below:

Column 7, line 58, "head's pair" should be -- head's pin pair --

Column 8, line 68, "50" should be -- 40 --

Column 13, line 61, "blick" should be -- block --

Column 15, line 29 "primaryy" should be -- primary --

Column 19, line 47, "53" should be -- 47 --

Column 23, line 35, "if" should be -- of --

Column 23, line 66, "providing" should be -- provided --

Signed and Sealed this

*Nineteenth* Day of *May 1981*

[SEAL]

*Attest:*

RENE D. TEGTMEYER

*Attesting Officer*

*Acting Commissioner of Patents and Trademarks*